US009564138B2

(12) United States Patent
Oh et al.

(10) Patent No.: US 9,564,138 B2
(45) Date of Patent: Feb. 7, 2017

(54) METHOD AND DEVICE FOR PROCESSING AUDIO SIGNAL

(71) Applicant: INTELLECTUAL DISCOVERY CO., LTD., Seoul (KR)

(72) Inventors: Hyun Oh Oh, Seongnam-si (KR); Jeongook Song, Seoul (KR); Myungsuk Song, Seoul (KR); Sewoon Jeon, Seoul (KR); Taegyu Lee, Seoul (KR)

(73) Assignee: INTELLECTUAL DISCOVERY CO., LTD., Seoul (KR)

( * ) Notice: Subject to any disclaimer, the term of this patent is extended or adjusted under 35 U.S.C. 154(b) by 192 days.

(21) Appl. No.: 14/414,910

(22) PCT Filed: Jul. 26, 2013

(86) PCT No.: PCT/KR2013/006732

§ 371 (c)(1),
(2) Date: Jan. 15, 2015

(87) PCT Pub. No.: WO2014/021588

PCT Pub. Date: Feb. 6, 2014

(65) Prior Publication Data

US 2015/0194158 A1 Jul. 9, 2015

(30) Foreign Application Priority Data

Jul. 31, 2012 (KR) ..... 10-2012-0083944
Jul. 31, 2012 (KR) ..... 10-2012-0084229
(Continued)

(51) Int. Cl.
*G10L 19/008* (2013.01)
*H04S 7/00* (2006.01)

(52) U.S. Cl.
CPC ..... *G10L 19/008* (2013.01); *H04S 7/30* (2013.01)

(58) Field of Classification Search
CPC ..... G10L 19/008; H04S 7/30
(Continued)

(56) References Cited

U.S. PATENT DOCUMENTS 8,204,756 B2 * 6/2012 Kim ..... G10L 19/008 381/2
8,396,575 B2 * 3/2013 Kraemer ..... G10L 19/00 700/94
(Continued)

FOREIGN PATENT DOCUMENTS

JP 2010-507114 A 3/2010
JP 5291096 B 6/2013
(Continued)

OTHER PUBLICATIONS

International Search Report of PCT/KR2013/006732 dated Nov. 27, 2013.

*Primary Examiner* — David Ton

(57) ABSTRACT

The present invention relates to a method and device for encoding or decoding an object audio signal or rendering the object audio signal in a three-dimensional space. The method for processing an audio signal, according to one aspect of the present invention, comprises the steps of: generating a first object signal group and a second object signal group obtained by classifying a plurality of object signals according to a determined method; generating a first down-mix signal for the first object signal group; generating a second down-mix signal for the second object signal group; generating first object extraction information in correspondence with the first down-mix signal with respect to object signals included in the first object signal group; and generating second object extraction information in correspondence with the second down-mix signal with respect to object signals included in the second object signal group.

7 Claims, 19 Drawing Sheets

(30) Foreign Application Priority Data

Jul. 31, 2012 (KR) ..... 10-2012-0084230
Jul. 31, 2012 (KR) ..... 10-2012-0084231

(58) Field of Classification Search
USPC . 381/22, 23; 704/500, 501, E19.005; 700/94
See application file for complete search history.

(56) References Cited

U.S. PATENT DOCUMENTS

| | | | | |
|---|---|---|---|---|
| 2008/0140426 | A1* | 6/2008 | Kim | G10L 19/008 704/500 |
| 2008/0201152 | A1 | 8/2008 | Pang et al. | |
| 2009/0210239 | A1 | 8/2009 | Yoon et al. | |
| 2011/0013790 | A1* | 1/2011 | Hilpert | G10L 19/008 381/300 |
| 2012/0093322 | A1 | 4/2012 | Lee | |
| 2012/0183148 | A1 | 7/2012 | Cho et al. | |
| 2014/0133683 | A1* | 5/2014 | Robinson | H04S 3/008 381/303 |

FOREIGN PATENT DOCUMENTS

| | | | |
|---|---|---|---|
| JP | 5302207 | B | 6/2013 |
| JP | 5883561 | B | 2/2016 |
| KR | 10-2008-0089308 | A | 10/2008 |
| KR | 10-2009-0057131 | A | 6/2009 |
| WO | 2008/046531 | A1 | 4/2008 |
| WO | 2008/120933 | A1 | 10/2008 |
| WO | 2010109918 | A1 | 9/2010 |

* cited by examiner

METHOD AND DEVICE FOR PROCESSING AUDIO SIGNAL

TECHNICAL FIELD

The present invention relates generally to an object audio signal processing method and device and, more particularly, to a method and device for encoding and decoding object audio signals or for rendering object audio signals in a three-dimensional (3D) space.

BACKGROUND ART 3D audio integrally denotes a series of signal processing, transmission, encoding, and reproducing technologies for literally providing sounds with presence in a 3D space by providing another axis (dimension) in the direction of height to a sound scene (2D) on a horizontal plane provided by existing surround audio technology. In particular, in order to provide 3D audio, a larger number of speakers than that of conventional technology are used or, alternatively, rendering technology is widely required which forms sound images at virtual locations where speakers are not present even if a small number of speakers are used.

It is expected that 3D audio will become an audio solution corresponding to an ultra-high definition television (UHDTV) that will be released in the future, and that it will be variously applied to cinema sounds, sounds for a personal 3D television (3DTV), a tablet, a smartphone, and a cloud game, etc. as well as sounds in vehicles that are evolving into a high-quality infotainment space.

DISCLOSURE

Technical Problem

Three-dimensional (3D) audio technology requires the transmission of signals through a larger number of channels up to a maximum of 22.2 channels than those of conventional technology. For this, compression transmission technology suitable for such transmission is required. Conventional high-quality coding such as MPEG audio layer 3 (MP3), Advanced Audio Coding (AAC), Digital Theater Systems (DTS), and Audio Coding-3 (AC3), was mainly adapted to the transmission of signals of only channels fewer than 5.1 channels.

Further, in order to reproduce 22.2 channel signals, there is an infrastructure for a listening space in which 24 speaker systems are installed, but it is not easy to propagate such an infrastructure via markets for a short period of time. Accordingly, there are required technology for effectively reproducing 22.2 channel signals in a space having fewer speakers than 22.2 channels, technology for, on the contrary, reproducing existing stereo or 5.1 channel sound sources in an environment having 10.1 or 22.2 channel speakers more than existing sound sources, technology for providing sound scenes provided by original sound sources even in a place other than an environment having defined speaker locations and defined listening rooms, and technology for reproducing 3D sounds even in a headphone-listening environment. Such technologies are integrally referred to as "rendering" in the present invention, and are more specifically referred to as downmix, upmix, flexible rendering, binaural rendering, etc.

Meanwhile, as an alternative for effectively transmitting such a sound scene, an object-based signal transmission scheme is required. Depending on the sound source, it may be more favorable to perform object-based transmission rather than channel-based transmission. In addition, object-based transmission enables the interactive listening of a sound source such as by allowing a user to freely adjust the reproduction size and location of objects. Accordingly, there is required an effective transmission method capable of compressing object signals at a high transfer rate.

Further, sound sources having a mixed form of channel-based signals and object-based signals may be present, and a new type of listening experience may be provided by means of the sound sources. Therefore, there is also required technology for effectively transmitting together channel signals and object signals and effectively rendering such signals.

Technical Solution

In accordance with an aspect of the present invention to accomplish the above object, there is provided an audio signal processing method, including generating a first object signal group and a second object signal group by classifying a plurality of object signals according to a designated method, generating a first downmix signal for the first object signal group, generating a second downmix signal for the second object signal group, generating first pieces of object extraction information for object signals included in the first object signal group in response to the first downmix signal, and generating second pieces of object extraction information for objects signals included in the second object signal group in response to the second downmix signal.

In accordance with another aspect of the present invention, there is provided an audio signal processing method, including receiving a plurality of downmix signals including a first downmix signal and a second downmix signal, receiving first object extraction information for a first object signal group corresponding to the first downmix signal, receiving second object extraction information for a second object signal group corresponding to the second downmix signal, generating object signals belonging to the first object signal group using the first downmix signal and the first object extraction information, and generating object signals belonging to the second object signal group using the second downmix signal and the second object extraction information.

Advantageous Effects

In accordance with the present invention, audio signals may be effectively represented, encoded, transmitted, and stored, and high-quality audio signals may be reproduced in various reproduction environments and via various devices.

The advantages of the present invention are not limited to the above-described effects, and effects not described here may be clearly understood by those skilled in the art to which the present invention pertains from the present specification and the attached drawings.

BEST MODE

Figure 1:
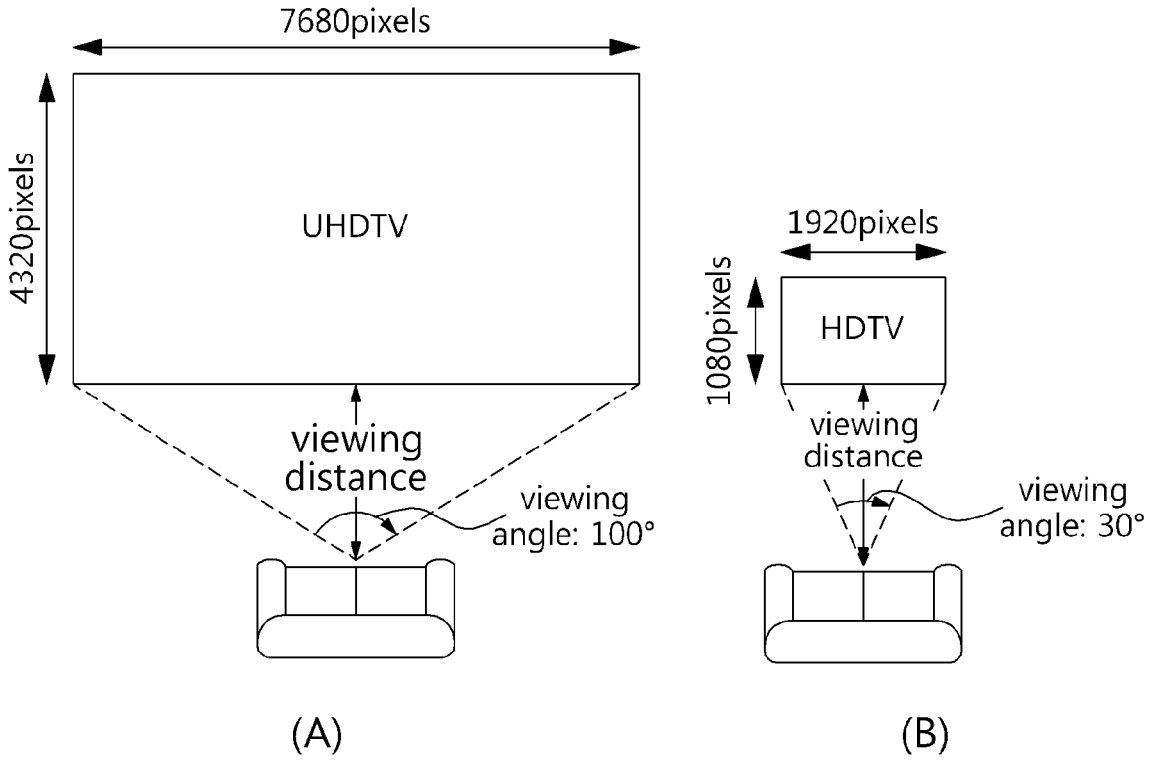
FIG. 1 is a diagram showing viewing angles depending on the sizes of an image at the same viewing distance.

In accordance with an aspect of the present invention, there can be provided an audio signal processing method, including generating a first object signal group and a second object signal group by classifying a plurality of object signals according to a designated method, generating a first downmix signal for the first object signal group, generating a second downmix signal for the second object signal group, generating first pieces of object extraction information for object signals included in the first object signal group in response to the first downmix signal, and generating second pieces of object extraction information for objects signals included in the second object signal group in response to the second downmix signal.

In this case, in the audio signal processing method, the first object signal group and the second object signal group may further include signals mixed with each other to form a single sound scene.

Further, in the audio signal processing method, the first object signal group and the second object signal group may be composed of signals reproduced at the same time.

In the present invention, the first object signal group and the second object signal group may be encoded into a single object signal bitstream.

Here, generating the first downmix signal may be configured to obtain the first downmix signal by applying pieces of downmix gain information for respective objects to object signals included in the first object signal group, wherein the pieces of downmix gain information for respective objects are included in the first object extraction information.

Here, the audio signal processing method may further include encoding the first object extraction information and the second object extraction information.

In the present invention, the audio signal processing method may further include generating global gain information for all object signals including the first object signal group and the second object signal group, wherein the global gain information may be encoded into the object signal bitstream.

In accordance with another aspect of the present invention, there is provided an audio signal processing method, including receiving a plurality of downmix signals including a first downmix signal and a second downmix signal, receiving first object extraction information for a first object signal group corresponding to the first downmix signal, receiving second object extraction information for a second object signal group corresponding to the second downmix signal, generating object signals belonging to the first object signal group using the first downmix signal and the first object extraction information, and generating object signals belonging to the second object signal group using the second downmix signal and the second object extraction information.

Here, the audio signal processing method may further include generating output audio signals using at least one of the object signals belonging to the first object signal group and at least one of the object signals belonging to the second object signal group.

Here, the first object extraction information and the second object extraction information may be received from a single bitstream.

Further, the audio signal processing method may be configured such that downmix gain information for at least one of the object signal belonging to the first object signal group is obtained from the first object extraction information, and the at least one object signal is generated using the downmix gain information.

Further, the audio signal processing method may further include receiving global gain information, wherein the global gain information is a gain value applied both to the first object signal group and to the second object signal group.

Furthermore, at least one of the object signals belonging to the first object signal group and at least one of the object signals belonging to the second object signal group may be reproduced in an identical time slot.

Since embodiments described in the present specification are intended to clearly describe the spirit of the present invention to those skilled in the art to which the present invention pertains, the present invention is not limited to those embodiments described in the present specification, and it should be understood that the scope of the present invention includes changes or modifications without departing from the spirit of the invention.

The terms and attached drawings used in the present specification are intended to easily describe the present invention and shapes shown in the drawings are exaggerated to help the understanding of the present invention if necessary, and thus the present invention is not limited by the terms used in the present specification and the attached drawings.

In the present specification, detailed descriptions of known configurations or functions related to the present invention which have been deemed to make the gist of the present invention unnecessarily obscure will be omitted below.

The terms in the present invention may be construed based on the following criteria, and even terms, not described in the present specification, may be construed according to the following gist. Coding may be construed as encoding or decoding according to the circumstances, and information is a term encompassing values, parameters, coefficients, elements, etc. and may be differently construed depending on the circumstances, but the present invention is not limited thereto.

Hereinafter, a method and device for processing object audio signals according to embodiments of the present invention will be described.

FIG. 1 is a diagram showing viewing angles depending on the sizes (e.g., ultra-high definition TV (UHDTV) and high definition TV (HDTV)) of an image at the same viewing distance. With the development of production technology of displays and an increase in consumer demands, the size of an image is on an increasing trend. As shown in FIG. 1, a UHDTV image (7680*4320 pixel image) is about 16 times larger than a HDTV image (1920*1080 pixel image). When an HDTV is installed on the wall surface of a living room and a viewer is sitting on a sofa at a predetermined viewing distance, the viewing angle may be 30°. However, when a UHDTV is installed at the same viewing distance, the viewing angle reaches about 100°. In this way, when a high-quality and high-resolution large screen is installed, it is preferable to provide sound with high presence and immersive surround sound envelopment in conformity with large-scale content. To provide such an environment that a viewer feels as if he or she were present in a field, it may be insufficient to provide only one or two surround channel speakers. Therefore, a multichannel audio environment having a larger number of speakers and channels may be required.

As described above, in addition to a home theater environment, a personal 3D TV, a smart phone TV, a 22.2 channel audio program, a vehicle, a 3D video, a telepresence room, cloud-based gaming, etc. may be present.

Figure 2:
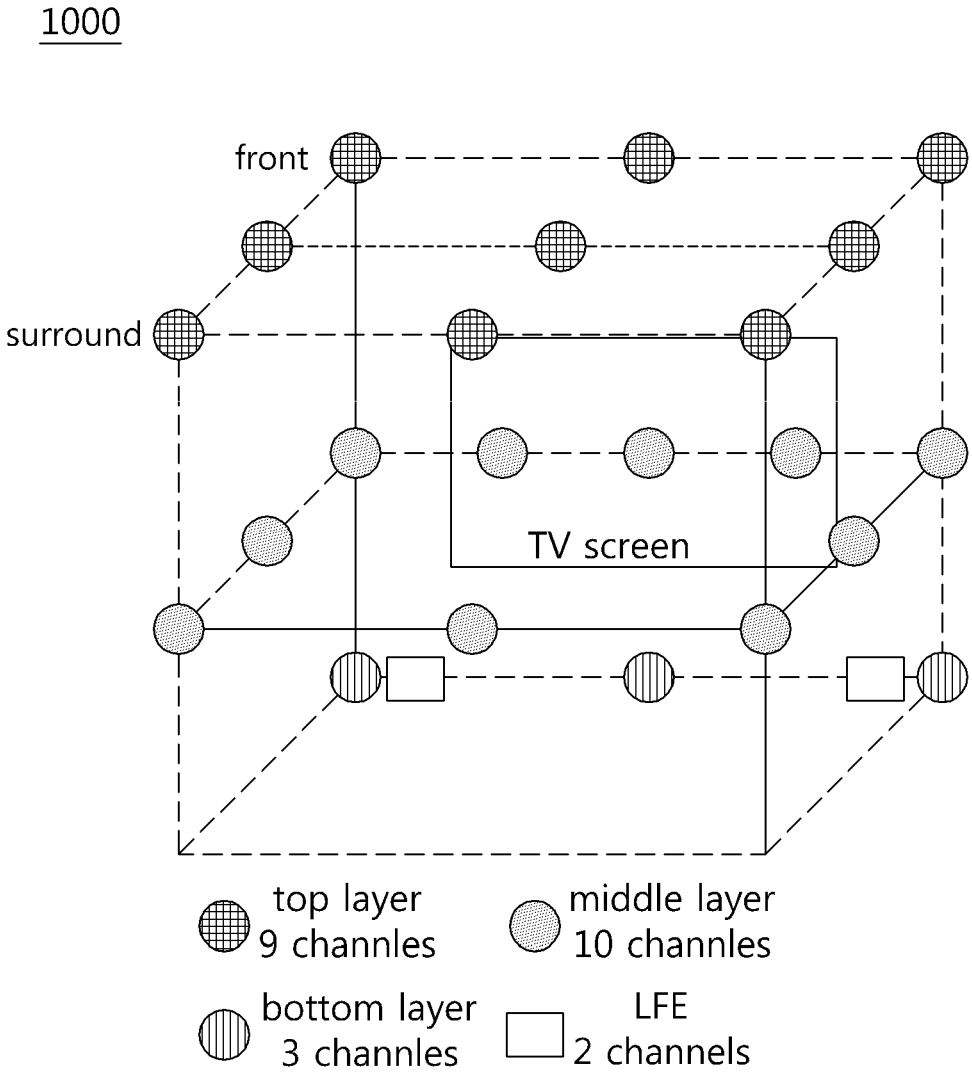
FIG. 2 is a configuration diagram showing the arrangement of 22.2 channel speakers as an example of a multi-channel environment.

FIG. 2 is a diagram showing an example of a multichannel environment, wherein the arrangement of 22.2 channel (ch) speakers is illustrated. The 22.2 channels may be an example of a multichannel environment for improving sound field effects, and the present invention is not limited to the specific number of channels or the specific arrangement of speakers. Referring to FIG. 2, a total of 9 channels may be provided to a top layer 1010. That is, it can be seen that a total of 9 speakers are arranged in such a way that 3 speakers are arranged in a top front position, 3 speakers are arranged in a top side/center positions, and three speakers are arranged in a top back position. On a middle layer 1020, 5 speakers may be arranged in a front position, 2 speakers are arranged in side positions, and 3 speakers may be arranged in a back position. Among the 5 speakers in the front position, 3 center speakers may be included in a TV screen. On a bottom layer 1030, 3 channels and 2 low-frequency effects (LFE) channels 1040 may be installed in a bottom front position.

In this way, upon transmitting and reproducing a multichannel signal ranging to a maximum of several tens of channels, a high computational load may be required. Further, in consideration of a communication environment or the like, high compressibility may be required. In addition, in typical homes, a multichannel (e.g., 22.2 ch) speaker environment is not frequently provided, and many listeners have 2 ch or 5.1 ch setup. Thus, in a case where signals to be transmitted in common to all users are sent after have been respectively encoded into a multichannel signal, communication inefficiency occurs when the multichannel signal must be converted back into 2 ch and 5.1 ch signals. In addition, 22.2 ch Pulse Code Modulation (PCM) signals must be stored, and thus memory management may be inefficiently performed.

Figure 3:
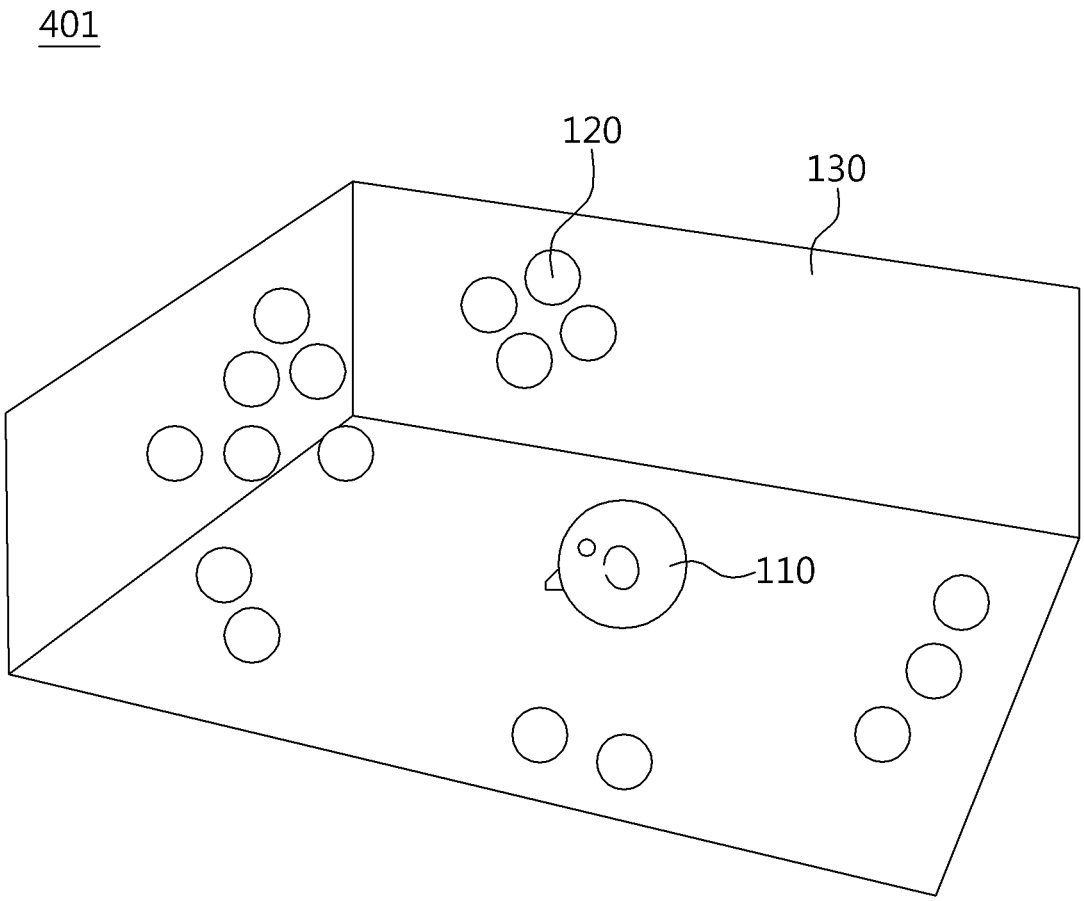
FIG. 3 is a conceptual diagram showing the locations of respective sound objects in a listening space in which a listener listens to 3D audio.

FIG. 3 is a conceptual diagram showing the locations of respective sound objects 120 constituting a 3D sound scene in a listening space 130 in which a listener 110 listens to 3D audio. Referring to FIG. 3, for convenience of illustration, respective objects 120 are shown as point sources, but may be plane wave-type sound sources or ambient sound sources (reverberant sounds spreading in all orientations to recognize the space of a sound scene) in addition to the point sources.

Figure 4:
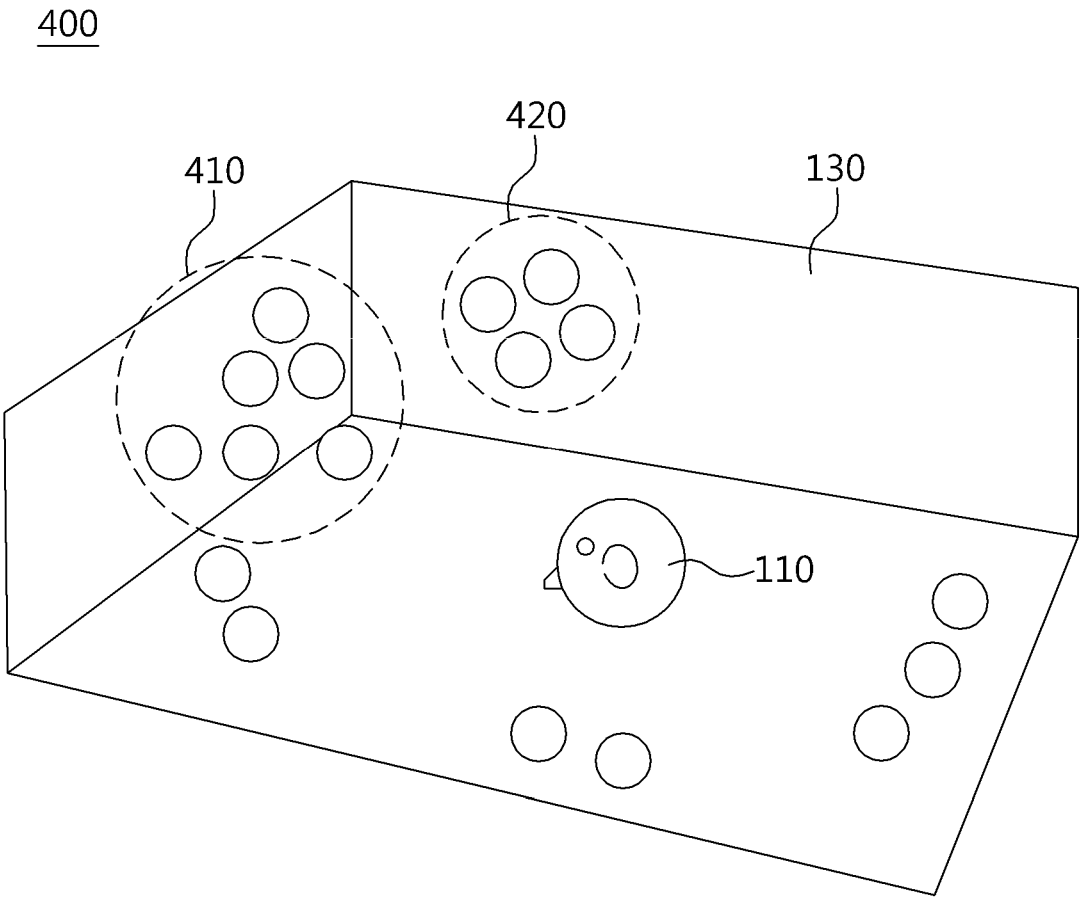
FIG. 4 is an exemplary configuration diagram showing the formation of object signal groups for objects shown in FIG. 3 using a grouping method according to the present invention.

FIG. 4 illustrates the formation of object signal groups 410 and 420 for the objects illustrated in FIG. 3 using a grouping method according to the present invention. The present invention is characterized in that, upon coding or processing object signals, object signal groups are formed and coding or processing is performed on a grouped object basis. In this case, coding includes a case where each object is independently encoded (discrete coding) as a discrete signal, and the case of parametric coding performed on object signals. In particular, the present invention is characterized in that, upon generating downmix signals required for parametric coding of object signals and generating parameter information of objects corresponding to downmixing, the downmix signals and the parameter information are generated on a grouped object basis. That is, in the case of Spatial Audio Object Coding (SAOC) coding technology as an example of conventional technology, all objects constituting a sound scene are represented by a single downmix signal (where a downmix signal may be mono (1 channel) or stereo (2 channel) signals, but is represented by a single downmix signal for convenience of description) and object parameter information corresponding to the downmix signal. However, using such a method, when 20 or more objects and a maximum of 200 or 500 objects are represented by a single downmix signal and a corresponding parameter as in the case of scenarios taken into consideration in the present invention, it is actually impossible to perform upmixing and rendering in which a desired sound quality is provided. Accordingly, the present invention uses a method of grouping objects to be targets of coding and generating downmix signals on a group basis. During a procedure of performing downmixing on a group basis, downmix gains may be applied to the downmixing of respective objects, and the applied downmix gains for respective objects are included as additional information in the bitstreams of the respective groups. Meanwhile, a global gain applied in common to individual groups and object group gains limitedly applied only to objects in each group may be used so as to improve the efficiency of coding or effectively control all gains. These gains are encoded and included in bitstreams and are transmitted to a receiving stage.

A first method of forming groups is a method of forming closer objects as a group in consideration of the locations of respective objects in a sound scene. Object groups 410 and 420 in FIG. 4 are examples of groups formed using such a method. This is a method for maximally preventing a listener 110 from hearing crosstalk distortion occurring between objects due to incompleteness of parametric coding or distortions occurring when objects are moved to a third location or when rendering related to a change in size is performed. There is a strong possibility that distortions occurring in objects placed at the same location will not be heard by the listener due to masking. For the same reason, even upon performing discrete coding, the effect of sharing additional information may be predicted via grouping of objects at a spatially similar location.

Figure 5:
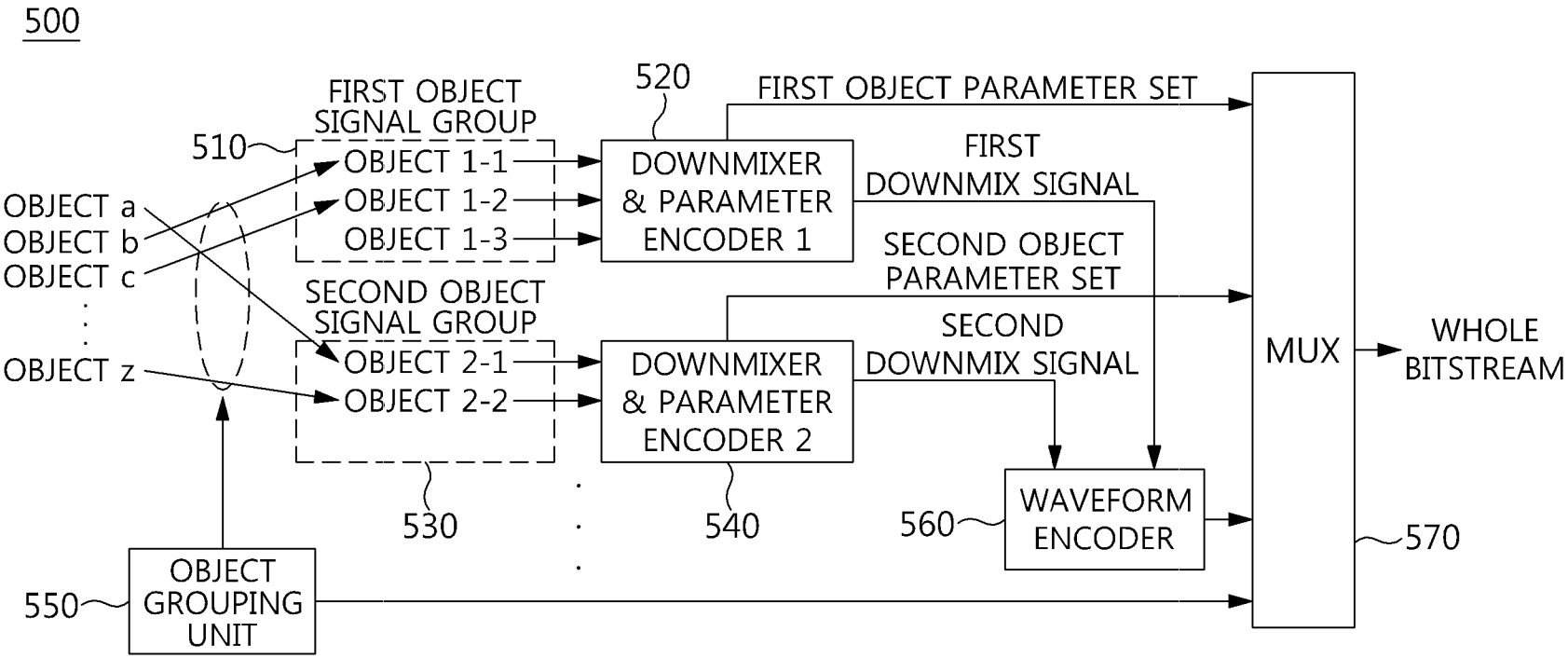
FIG. 5 is a configuration diagram showing an embodiment of an object audio signal encoder according to the present invention.

FIG. 5 is a block diagram showing an object audio signal encoder 500 according to an embodiment of the present invention. As shown in the drawing, the object audio signal encoder 500 may include an object grouping unit 550, and downmixer and parameter encoders 520 and 540. The object grouping unit 550 generates at least one object signal group by grouping a plurality of objects according to an embodiment of the present invention. In the embodiment of FIG. 5, although a first object signal group 510 and a second object signal group 530 are shown as being generated, the number of object signal groups in the embodiment of the present invention is not limited thereto. In this case, the respective object signal groups may be generated in consideration of spatial similarity as in the case of the method described in the example of FIG. 4, or may be generated by dividing objects depending on signal characteristics such as tones, frequency distribution, and sound pressures. Each of the downmixer and parameter encoders 520 and 540 performs downmixing for each generated group, and generates parameters required to restore downmixed objects in this procedure. The downmix signals generated for respective groups are additionally encoded by a waveform encoder 560 for coding channel-based waveforms such as AAC and MP3. This is commonly called a core codec. Further, encoding may be performed via coupling or the like between respective downmix signals. The signals generated by the respective encoders 520, 540, and 560 are formed as a single bitstream and transmitted through a multiplexer (MUX) 570. Therefore, bitstreams generated by the downmixer and parameter encoders 520 and 540 and the waveform encoder 560 may be regarded as signals obtained by coding component objects forming a single sound scene. Further, object signals belonging to different object groups in a generated bitstream are encoded in the same time frame, and thus they may have the characteristic of being reproduced in the same time slot. Meanwhile, the grouping information generated by the object grouping unit 550 may be encoded and transferred to a receiving stage.

Figure 6:
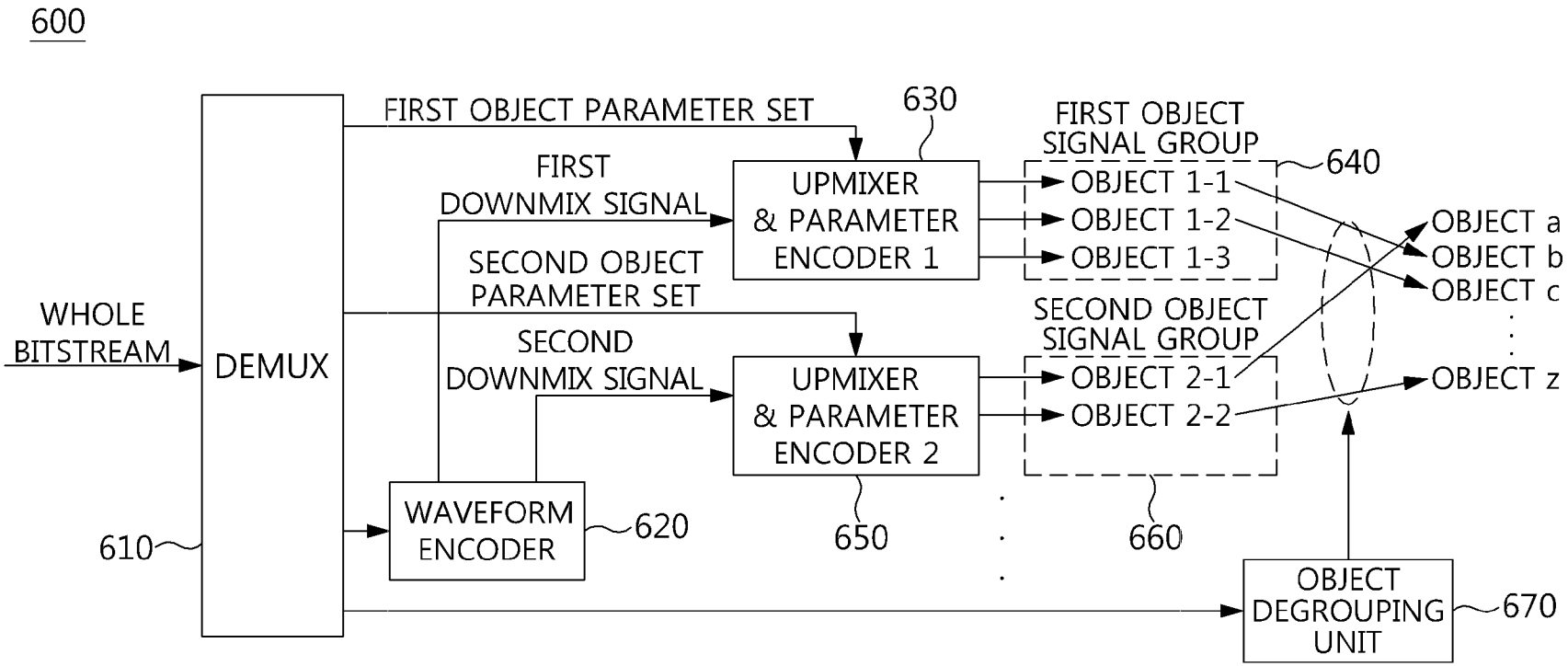
FIG. 6 is an exemplary configuration diagram of a decoding device according to an embodiment of the present invention.

FIG. 6 is a block diagram showing an object audio signal decoder 600 according to an embodiment of the present invention. The object audio signal decoder 600 may decode signals encoded and transmitted according to the embodiment of FIG. 5. A decoding procedure is the reverse procedure of encoding, wherein a demultiplexer (DEMUX) 610 receives a bitstream from the encoder, and extracts at least one object parameter set and a waveform-coded signal from the bitstream. If grouping information generated by the object grouping unit 550 of FIG. 5 is included in the bitstream, the DEMUX 610 may extract the corresponding grouping information from the bitstream. A waveform decoder 620 generates a plurality of downmix signals by performing waveform-decoding, and the plurality of generated downmix signals, together with respective corresponding object parameter sets, are input to upmixer and parameter decoders 630 and 650. The upmixer and parameter decoders 630 and 650 respectively upmix the input downmix signals and then decode the upmixed signals into one or more object signal groups 640 and 660. In this case, downmix signals and object parameter sets corresponding thereto are used to restore the respective object signal groups 640 and 660. In the embodiment of FIG. 6, since a plurality of downmix signals are present, the decoding of a plurality of parameters is required. In FIG. 6, although a first downmix signal and a second downmix signal are shown as being decoded into the first object signal group 640 and the second object signal group 660, respectively, the number of extracted downmix signals and the number of object signal groups corresponding thereto in the embodiment of the present invention are not limited thereto. Meanwhile, an object degrouping unit 670 may degroup each object signal group into individual object signals using the grouping information.

In accordance with the embodiment of the present invention, when a global gain and an object group gain are included in the transmitted bitstream, the magnitudes of normal object signals may be restored using the gains. Meanwhile, those gain values may be controlled in a rendering or transcoding procedure, and the magnitudes of all signals may be adjusted via the adjustment of the global gain and the magnitudes of signals for respective groups may be adjusted via the adjustment of object group gains. For example, when object grouping is performed on a play speaker basis, rendering may be easily implemented via the adjustment of object group gains upon adjusting the gains to implement flexible rendering, which will be described later.

In FIGS. 5 and 6, although a plurality of parameter encoders or decoders are shown as being processed in parallel for convenience of description, it is also possible to sequentially perform encoding or decoding on a plurality of object groups via a single system.

Another method of forming object groups is a method of grouping objects having low correlation into a single group. This method is performed in consideration of characteristics that it is difficult to individually separate objects having high correlation from downmix signals due to the features of parametric coding. In this case, it is also possible to perform a coding method that causes grouped individual objects to decrease correlations therebetween by adjusting parameters such as downmix gains upon downmixing. The parameters used in this case are preferably transmitted so that they can be used to restore signals upon decoding.

A further method of forming object groups is a method of grouping objects having high correlation into a single group. This method is intended to improve compression efficiency in an application, the availability of which is not high, although there is a difficulty in separating objects having high correlation using parameters. Since a complex signal having various spectrums requires more bits proportional to signal processing in a core codec, coding efficiency is high if objects having high correlation are grouped to utilize a single core codec.

Yet another method of forming object groups is to perform coding by determining whether masking has been performed between objects. For example, when object A has a relationship of masking object B, if two signals are included in a downmix signal and encoded using a core codec, the object B may be omitted in a coding procedure. In this case, when the object B is obtained using parameters in a decoding stage, distortion is increased. Therefore, the objects A and B having such a relationship are preferably included in separate downmix signals. In contrast, in the case of an application in which object A and object B have a relationship of masking, but there is no need to separately render two objects, or in a case where additional processing is not required for at least a masked object, the objects A and B are preferably included in a single downmix signal. Therefore, a selection method may differ according to the application. For example, when a specific object is masked and deleted or is at least weak in a preferable sound scene in a coding procedure, an object group may be implemented by excluding the deleted or weak object from an object list and including it in an object that will be a masker, or by combing two objects and representing them by a single object.

Still another method of forming an object group is a method of separating objects such as plane wave source objects or ambient source objects, other than point source objects, and grouping the separated objects. Due to characteristics differing from those of the point sources, the sources require another type of compression encoding method or parameters, and thus it is preferable to separate and process the sources.

In accordance with an embodiment of the present invention, grouping information may include information about a method by which the above-described object groups are formed. The audio signal decoder may perform object degrouping that reconstructs decoded object signal groups into original objects by referring to the transmitted grouping information.

Figure 7:
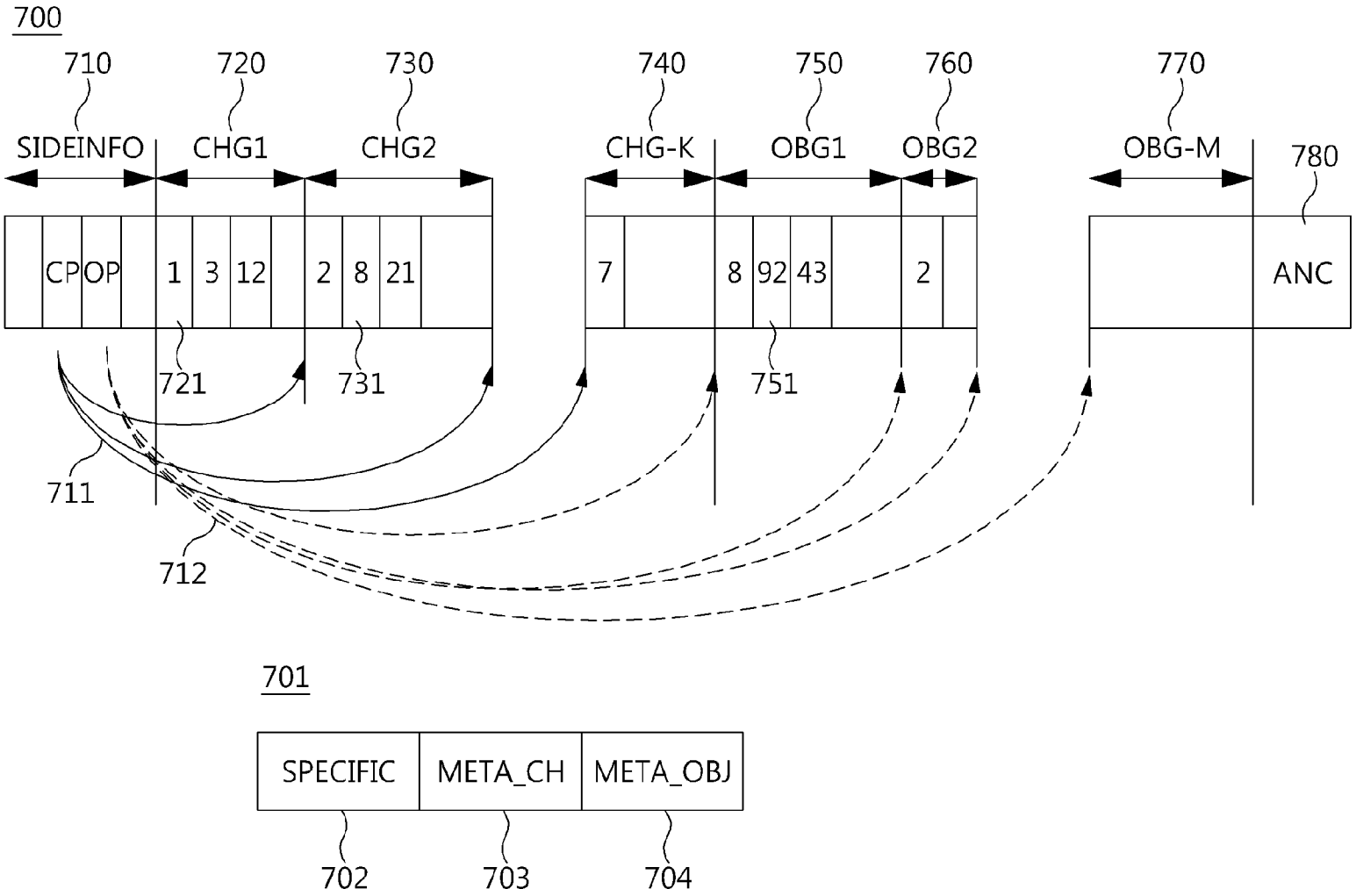
FIG. 7 is a diagram showing an example of a bitstream generated by performing encoding using an encoding method according to the present invention.

FIG. 7 is a diagram showing an example of a bitstream generated by performing encoding according to the encoding method of the present invention. Referring to FIG. 7, it can be seen that a main bitstream 700 by which encoded channel or object data is transmitted is aligned in the sequence of channel groups 720, 730, and 740 or in the sequence of object groups 750, 760, and 770. In each channel group, individual channels belonging to the corresponding channel group are aligned and arranged in a preset sequence. Reference numerals 721, 731, and 751 denote examples indicating signals of channel 1, channel 8, and channel 92, respectively. Further, since a header 710 includes channel group location information CHG_POS_INFO 711 and object group location information OBJ_POS_INFO 712 which correspond to pieces of location information of respective groups in the bitstream, only data of a desired group may be primarily decoded without sequentially decoding the bitstream. Therefore, the decoder primarily decodes data that has arrived first on a group basis, but the sequence of decoding may be randomly changed due to another policy or reason. Further, FIG. 7 illustrates a sub-bitstream 701 containing metadata 703 and 704 for each channel or each object, together with principal decoding-related information, in addition to the main bitstream 700. The sub-bitstream may be intermittently transmitted while the main bitstream is transmitted, or may be transmitted through a separate transmission channel. Meanwhile, subsequent to the channel and object signals, ancillary (ANC) data 780 may be selectively included.

(Method of Allocating Bits to Each Group)

Upon generating downmix signals for respective groups, and performing independent parametric object coding for respective groups, the number of bits used in each group may differ from that of other groups. For criteria for allocating bits to respective groups, the number of objects contained in each group, the number of effective objects considering masking effect between objects in the group, weights depending on locations considering the spatial resolution of a person, the intensities of sound pressures of objects, correlations between objects, the importance levels of objects in a sound scene, etc. may be taken into consideration. For example, when three spatial object groups A, B, and C are present, and they have three object signals, two object signals, and one object signal, respectively, bits allocated to the respective groups may be defined as 3a1(n−x), 2a2(n−y), and a3n, where x and y denote degrees to which the number of bits to be allocated may be reduced due to masking effect between objects in each group and in each object, and a1, a2, and a3 may be determined by the above-described various factors for each group.

(Encoding of Location Information of Main Object and Sub-Object in Object Group)

Meanwhile, in the case of object information, it is preferable to have a means for transferring mix information or the like, recommended according to an intention created by a producer or proposed by another user, as the location and size information of the corresponding object through metadata. In the present invention, such a means is called preset information for the sake of convenience. When an object is a dynamic object, the location of which varies over time, the amount of location information to be transmitted through the preset information is not small. For example, if it is assumed that, for 1000 objects, the location information thereof varying in each frame is transmitted, a very large amount of data is obtained. Therefore, it is preferable to effectively transmit even the location information of objects. Therefore, the present invention uses a method of effectively encoding location information using the definition of "main object" and "sub-object."

A main object denotes an object, the location information of which is represented by absolute coordinate values in a 3D space. A sub-object denotes an object, the location of which, in a 3D space, is represented by relative values to the main object, thus having location information. Therefore, in order to detect the location information of a sub-object, the corresponding main object must be identified first. In accordance with an embodiment of the present invention, when grouping is performed, in particular, when grouping is performed based on spatial locations, grouping may be implemented using a method of representing location information by setting a single object to a main object and remaining objects to sub-objects in the same group. When grouping for encoding is not performed, or when the use of grouping is not favorable to the encoding of the location information of sub-objects, a separate set for location information encoding may be formed. In order to cause the relative representation of location information of sub-objects to be more profitable than the representation thereof using absolute values, it is preferable that objects belonging to a group or a set be located within a predetermined range in the space.

Another location information encoding method according to the present invention is to represent the location information of each object as relative information to the location of a fixed speaker instead of the representation of relative locations to a main object. For example, the relative location information of each object is represented with respect to the designated locations of 22 channel speakers. Here, the number and location values of speakers to be used as a reference may be determined with reference to values set in current content.

In accordance with another embodiment of the present invention, after location information is represented by an absolute value or a relative value, quantization is performed, wherein a quantization step is characterized by being variable with respect to an absolute location. For example, it is known that a listener has location identification ability in his or her front portion much higher than that in side or back portions, and thus it is preferable to set a quantization step so that the resolution of a front area is higher than that of a side area. Similarly, since a person has higher resolution in orientation than resolution in height, it is preferable to set a quantization step so that the resolution of azimuth angles is higher than that of altitude.

In a further embodiment the present invention, in the case of a dynamic object, the location of which is time-varying, it is possible to represent the location information of the dynamic object by a value relative to its previous location value, instead of representing the relative location value to a main object or another reference point. Therefore, for the location information of a dynamic object, flag information required to determine which one of a previous point in temporal aspect and a neighboring reference point in spatial aspect has been used as a reference may be transmitted together with the location information.

(Entire Architecture of Decoder)

Figure 8:
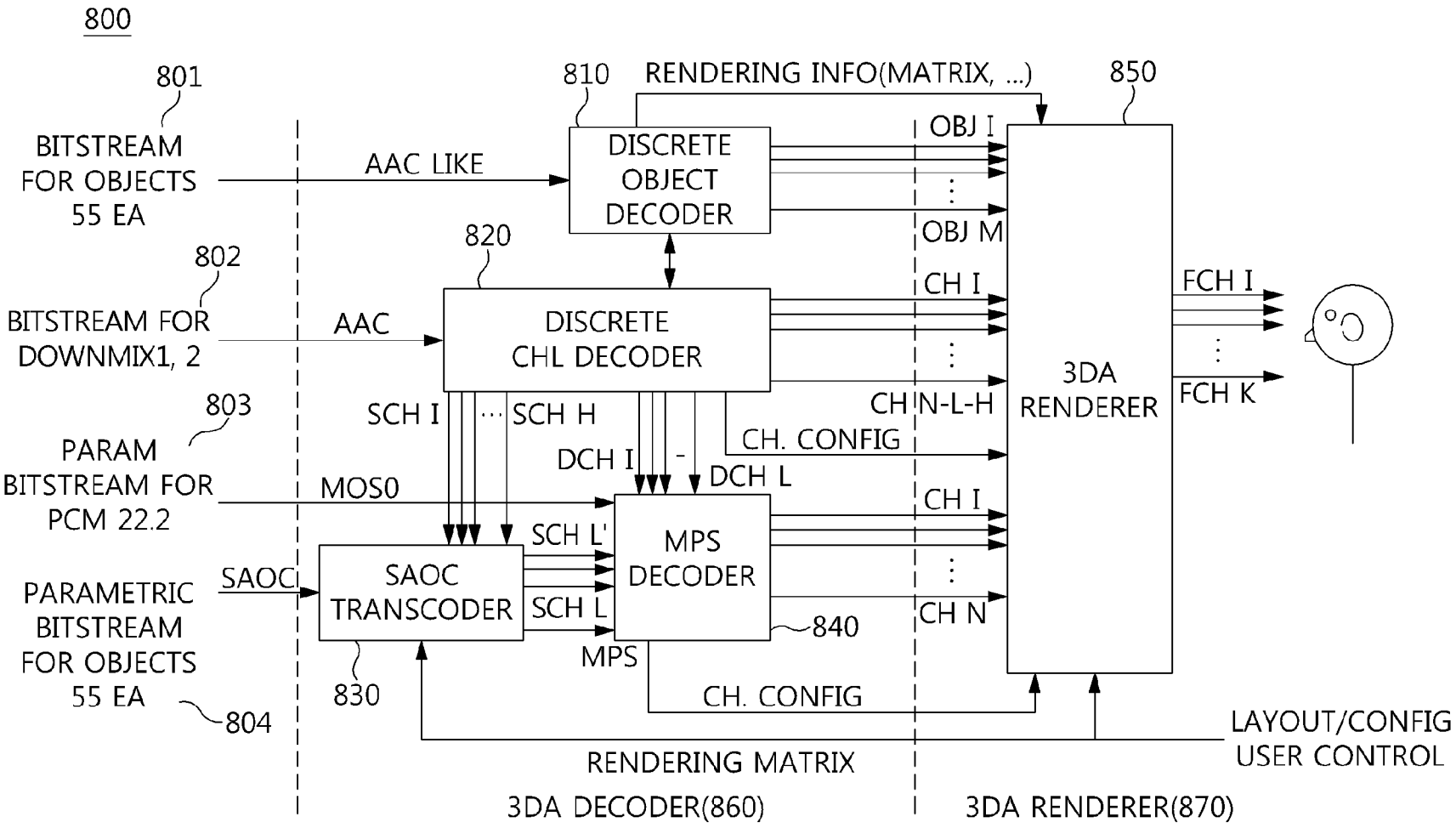
FIG. 8 is a block diagram showing an embodiment of an object and channel signal decoding system according to the present invention.

FIG. 8 is a block diagram showing an embodiment of an object and channel signal decoding system 800 according to the present invention. The system 800 may receive an object signal 801, a channel signal 802, or a combination of the object signal and the channel signal. Further, the object signal or the channel signal may be waveform-coded (801, 802) or parametrically coded (803, 804). The decoding system 800 may be chiefly divided into a 3D Architecture (3DA) decoder 860 and a 3DA renderer 870, wherein the 3DA renderer 870 may be implemented using any external system or solution. Therefore, the 3DA decoder 860 and the 3DA renderer 870 preferably provide a standardized interface easily compatible with external systems.

Figure 9:
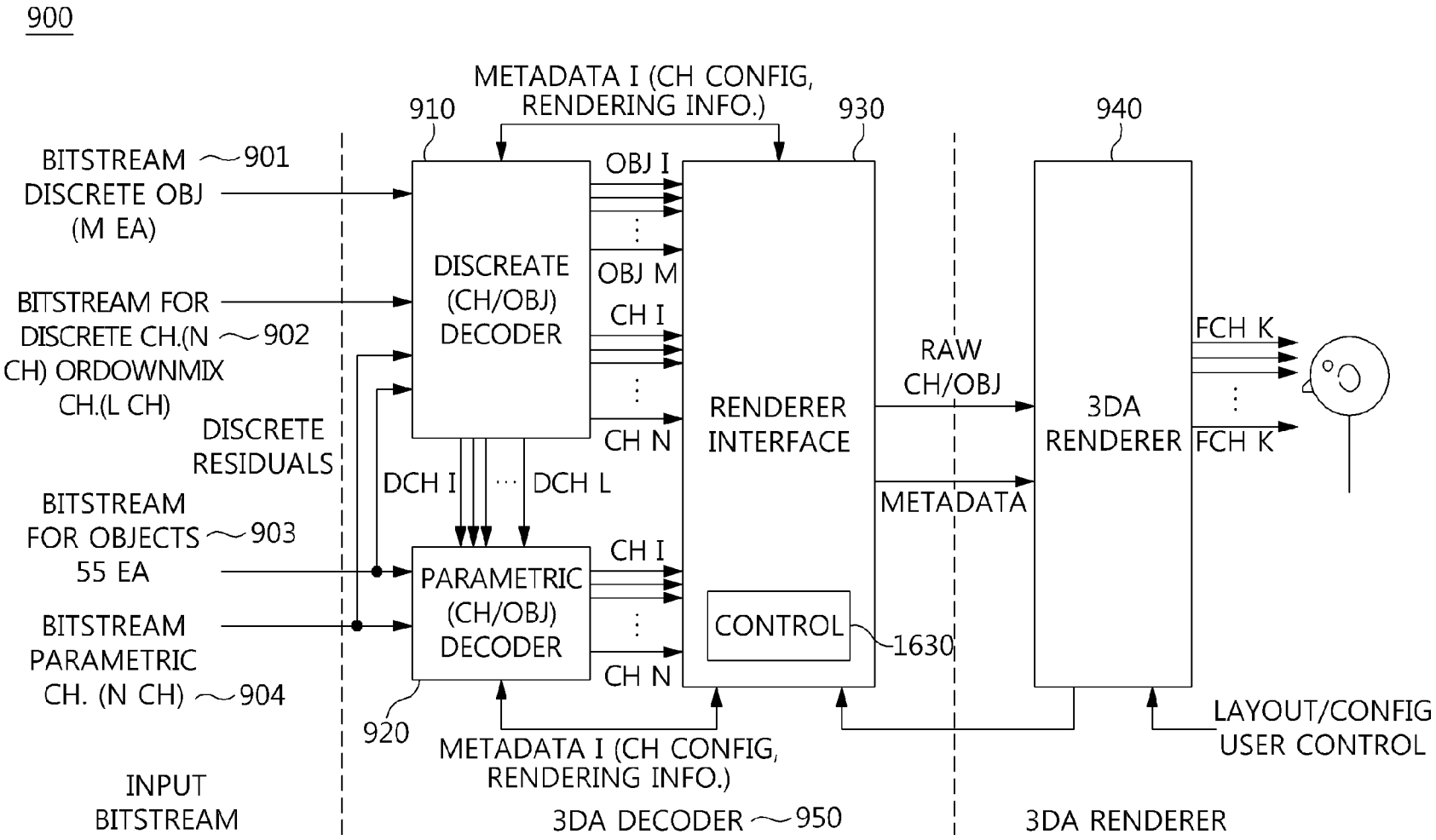
FIG. 9 is a block diagram showing another embodiment of an object and channel signal decoding system according to the present invention.

FIG. 9 is a block diagram showing an object and channel signal decoding system 900 according to another embodiment of the present invention. Similarly, the system 900 may receive an object signal 901, a channel signal 902, or a combination of the object signal and the channel signal. Further, the object signal or channel signal may be individually waveform-coded (901, 902) or may be parametrically coded (903, 904). Compared to the system 800 of FIG. 8, the decoding system 900 of FIG. 9 has a difference in that a discrete object decoder 810 and a discrete channel decoder 820 that are separately provided and a parametric channel decoder 840 and a parametric object decoder 830 that are separately provided are respectively integrated into a single discrete decoder 910 and into a single parametric decoder 920. Further, in the decoding system 900 of FIG. 9, a 3DA renderer 940 and a renderer interface 930 for convenient and standardized interfacing are additionally provided. The renderer interface 930 functions to receive user environment information, renderer version, etc. from the 3DA renderer 940 present inside or outside of the system, generate a type of channel signal or object signal compatible with the received information, and transfer the generated signal to the 3DA renderer 940. Further, in order to provide additional information required for reproduction, such as the number of channels and the names of respective objects, to a user, required metadata may be configured in a standardized format and may be transferred to the 3DA renderer 940. The renderer interface 930 may include a sequence control unit 1630, which will be described later.

The parametric decoder 920 requires a downmix signal to generate an object signal or a channel signal, and such a required downmix signal is decoded and input by the discrete decoder 910. The encoder corresponding to the object and channel signal decoding system may be any of various types of encoders, and any type of encoder may be regarded as a compatible encoder as long as it may generate at least one of types of bitstreams 801, 802, 803, 804, 901, 902, 903, and 904 illustrated in FIGS. 8 and 9. Further, according to the present invention, the decoding systems presented in FIGS. 8 and 9 are designed to guarantee compatibility with past systems or bitstreams. For example, when a discrete channel bitstream encoded using Advanced Audio Coding (AAC) is input, the corresponding bitstream may be decoded by a discrete (channel) decoder and may be transmitted to the 3DA renderer. An MPEG Surround (MPS) bitstream is transmitted together with a downmix signal. A signal that has been encoded using AAC after being downmixed is decoded by a discrete (channel) decoder and is transferred to the parametric channel decoder, and the parametric channel decoder operates like an MPEG surround decoder. A bitstream that has been encoded using Spatial Audio Object Coding (SAOC) is processed in the same manner. The system 800 of FIG. 8 has a structure in which a SAOC bitstream is transcoded by the SAOC transcoder 830 as in the case of a conventional scheme, and then the transcoded SAOC bitstream is rendered to a discrete channel through the MPEG surround decoder 840. For this, the SAOC transcoder 830 preferably receives reproduction channel environment information, generates an optimized channel signal suitable for such environment information, and transmits the optimized channel signal. Therefore, the object and channel signal decoding system according to the present invention may receive and decode a conventional SAOC bitstream, and may perform rendering specialized for a user or a reproduction environment. When a SAOC bitstream is input, the system 900 of FIG. 9 performs decoding using a method of directly converting the SAOC bitstream into a channel or a discrete object suitable for rendering instead of a transcoding operation for converting the SAOC bitstream into an MPS bitstream. Therefore, the system 900 has a lower computational load than that of a transcoding structure, and is advantageous even in sound quality. In FIG. 9, the output of the object decoder is indicated by only "channels", but may also be transferred to the renderer interface 930 as discrete object signals. Further, although shown only in FIG. 9, in a case where a residual signal is included in a parametric bitstream, including the case of FIG. 8, there is a characteristic in that the decoding of the residual signal is performed by a discrete decoder.

(Discrete, Parameter Combination, and Residual for Channels)

Figure 10:
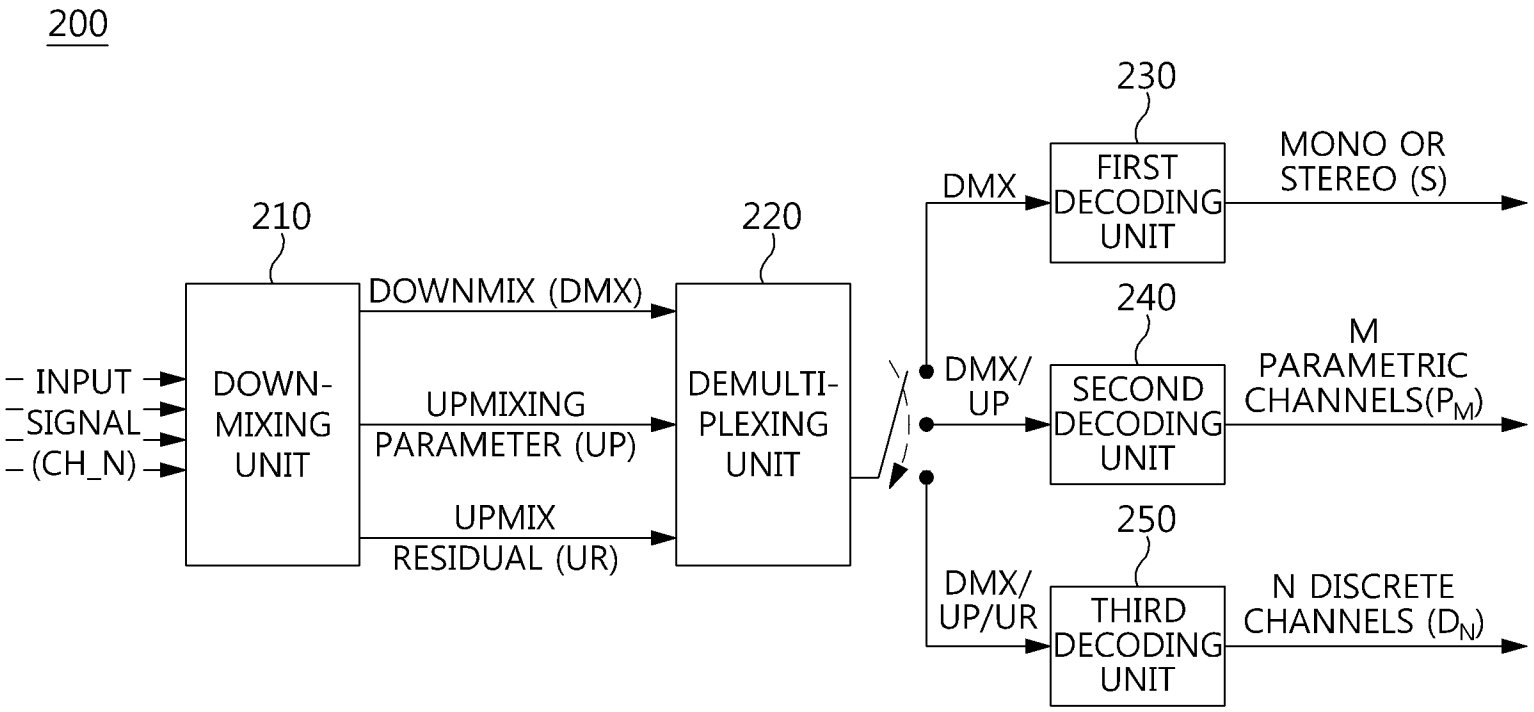
FIG. 10 illustrates an embodiment of a decoding system according to the present invention.

FIG. 10 is a diagram showing the configuration of an encoder and a decoder according to another embodiment of the present invention.

FIG. 10 is a diagram showing a structure for scalable coding when speaker setup of the decoder is differently implemented.

An encoder includes a downmixing unit 210, and a decoder includes one or more of first to third decoding units 230 to 250 and a demultiplexing unit 220.

The downmixing unit 210 downmixes input signals CH_N corresponding to multiple channels to generate a downmix signal DMX. In this procedure, one or more of an upmix parameter UP and upmix residual UR are generated. Then, the downmix signal DMX and the upmix parameter UP (and the upmix residual UR) are multiplexed, and thus one or more bit streams are generated and transmitted to the decoder.

Here, the upmix parameter UP, which is a parameter required to upmix one or more channels into two or more channels, may include a spatial parameter, an inter-channel phase difference (IPD), etc.

Further, the upmix residual UR corresponds to a residual signal corresponding to a difference between the input signal CH_N that is an original signal, and a restored signal. Here, the restored signal may be either an upmixed signal obtained by applying the upmix parameter UP to the downmix signal DMX or a signal obtained by encoding a channel signal, which is not downmixed by the downmixing unit 210, in a discrete manner.

The demultiplexing unit 220 of the decoder may extract the downmix signal DMX and the upmix parameter UP from one or more bitstreams and may further extract residual upmix UR. Here, the residual signal may be encoded using a method similar to a method of discretely coding a downmix signal. Therefore, the decoding of the residual signal is characterized by being performed via the discrete (channel) decoder in the system presented in FIG. 8 or 9.

The decoder may selectively include one (or one or more) of the first decoding unit 230 to the third decoding unit 250 according to the speaker setup environment. The setup environment of a loud speaker may be various depending on the type of device (smart phone, stereo TV, 5.1 ch home theater, 22.2 ch home theater, etc.). In spite of various environments, unless bitstreams and decoders for generating a multichannel signal such as 22.2 ch signals are selective, all of 22.2 ch signals are restored and thereafter must be downmixed depending on a speaker play environment. In this case, not only a high computational load required for restoration and downmixing, but also a delay, may be caused.

However, in accordance with another embodiment of the present invention, a decoder selectively includes one (one or more) of first to third decoding units depending on the setup environment of each device, thus solving the above-described disadvantage.

The first decoding unit 230 is a component for decoding only a downmix signal DMX, and does not accompany an increase in the number of channels. That is, the first decoding unit 230 outputs a mono-channel signal when a downmix signal is a mono signal, and outputs a stereo signal when the downmix signal is a stereo signal. The first decoding unit 230 may be suitable for a device, a smart phone or TV, the number of speaker channels is one or two.

Meanwhile, the second decoding unit 240 receives the downmix signal DMX and the upmix parameter UP, and generates a parametric M channel PM. The second decoding unit 240 increases the number of output channels compared to the first decoding unit 230. However, when upmix parameter UP includes only parameters corresponding to upmixing ranging to a total of M channels, the second decoding unit 240 may output M channel signals, the number of which does not reach the number of original channels N. For example, when an original signal, which is the input signal of the encoder, is a 22.2 ch signal, M channels may be 5.1 ch, 7.1 ch, etc.

The third decoding unit 250 receives not only downmix signal DMX and the upmix parameter UP, but also the upmix residual UR. Unlike the second decoding unit 240 that generates M parametric channel signals, the third decoding unit 250 additionally applies the upmix residual signal UR to the parametric channel signals, thus outputting restored signals of N channels.

Each device selectively includes one or more of first to third decoding units, and selectively parses an upmix parameter UP and an upmix residual UR from the bitstreams, so that signals suitable for each speaker setup environment are immediately generated, thus reducing complexity and a computational load.

(Object Waveform Coding in Which Masking is Considered)

An object waveform encoder according to the present invention (hereinafter, a waveform encoder denotes a case where a channel audio signal or an object audio signal is encoded so that it is independently decoded for each channel or for each object, and waveform coding/decoding is a concept opposite to that of parametric coding/decoding and is also called discrete coding/decoding) allocates bits in consideration of locations of objects in a sound scene. This uses a psychoacoustic Binaural Masking Level Difference (BMLD) phenomenon and the features of object signal coding.

In order to describe the BMLD phenomenon, mid-side (MS) stereo coding used in an existing audio coding method will be described as follows. That is, a BMLD is a psychoacoustic masking phenomenon meaning that masking is possible when a masker causing masking and a maskee to be masked are present in the same direction in a space. When a correlation between two channel audio signals of stereo audio signals is very high, and the magnitudes of the signals are identical to each other, an image (sound image) for the sounds is formed at the center of a space between two speakers. When a correlation therebetween is not present, independent sounds are output from respective speakers and the sound images thereof are respectively formed on the speakers. When respective channels are independently encoded (dual mono manner) for input signals having a maximum correlation, sound images of audio signals are formed at the center and sound images of quantization noises are separately formed on the respective speakers. That is, since quantization noises in the respective channels do not have a correlation, the images thereof are separately formed on the respective speakers. Therefore, quantization noises, intended to be the maskee, are not masked due to spatial mismatch, and thus a problem arises in that a person hears the corresponding noises as distortion. In order to solve such a problem, mid-side stereo coding is intended to generate a mid (sum) signal obtained by summing two channel signals and a side (difference) signal obtained by subtracting the two channel signals from each other, perform psychoacoustic modeling using the mid signal and the side signal, and perform quantization using a resulting psychoacoustic model. In accordance with this method, the sound images of the generated quantization are formed at the same location as that of the audio signals.

In conventional channel coding, respective channels are mapped to play speakers, and the locations of the corresponding speakers are fixed are spaced apart from each other, and thus masking between the channels cannot be taken into consideration. However, when respective objects are independently encoded, whether masking has been performed may vary depending on the locations of the corresponding objects in a sound scene. Therefore, it is preferable to determine whether an object currently being encoded has been masked by other objects, allocate bits depending on the results of determination, and then encode each object.

Figure 11:
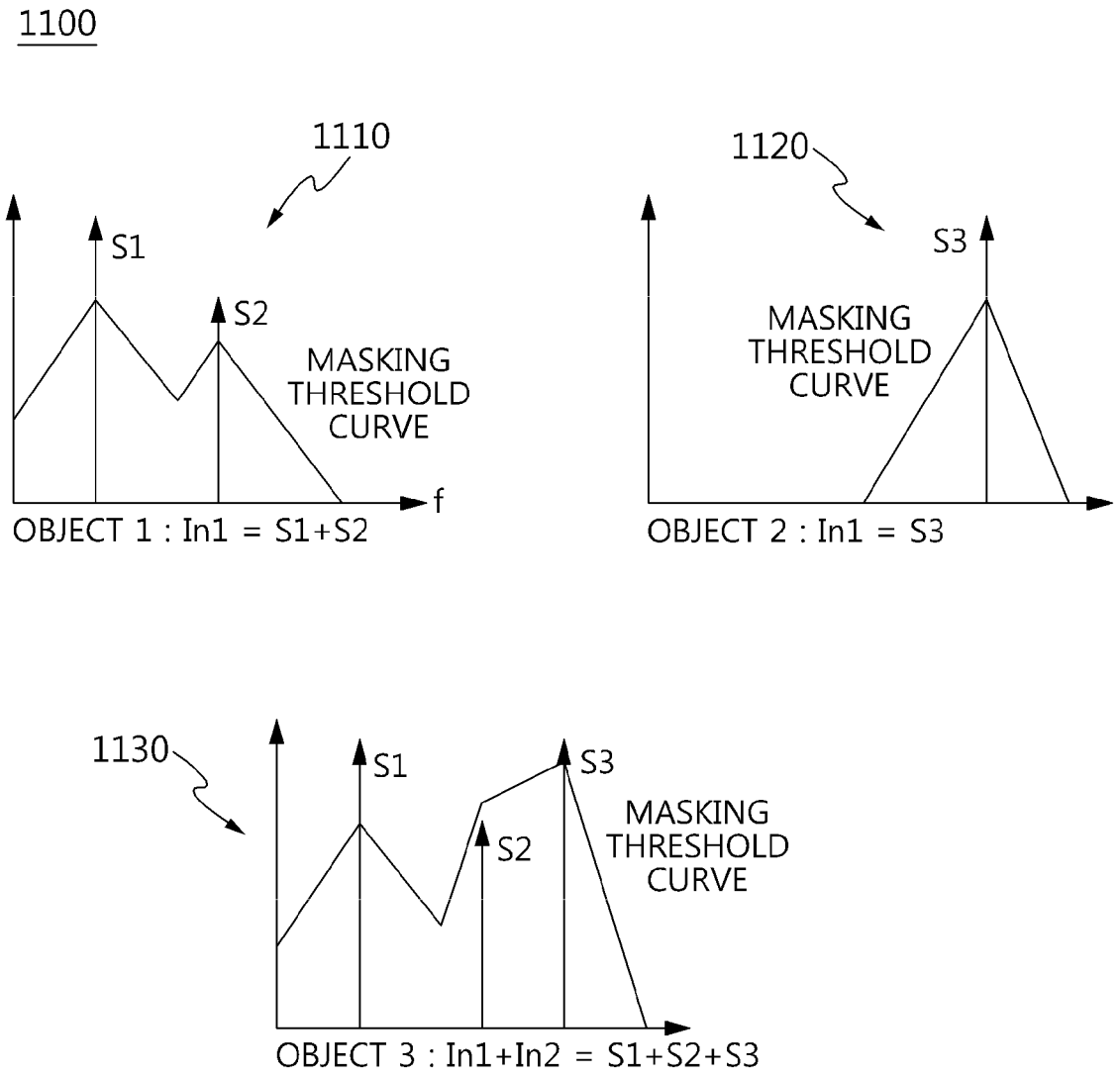
FIG. 11 is a diagram showing masking thresholds for a plurality of object signals according to the present invention.

FIG. 11 illustrates respective signals for object 1 and object 2, masking thresholds 1110 and 1120 that may be acquired from the signals, respectively, and a masking threshold 1130 for a sum signal of object 1 and object 2. When object 1 and object 2 are regarded as being located at the same location with respect to the location of a listener, or located within a range in which the problem of BMLD does not occur, an area masked by the corresponding signals may be given as 1130 to the listener, so that signal S2 included in object 1 will be a signal that is completely masked and inaudible. Therefore, in a procedure for encoding object 1, the object 1 is preferably encoded in consideration of the masking threshold of the object 2. Since the masking thresholds have the property of additively summing each other, the masking thresholds may be obtained even using a method of adding the respective masking thresholds for the object 1 and the object 2. Alternatively, since a procedure itself for calculating masking thresholds has a very high computational load, it is preferable to calculate a single masking threshold using a signal generated by previously summing the object 1 and the object 2, and to individually encode the object 1 and the object 2.

Figure 12:
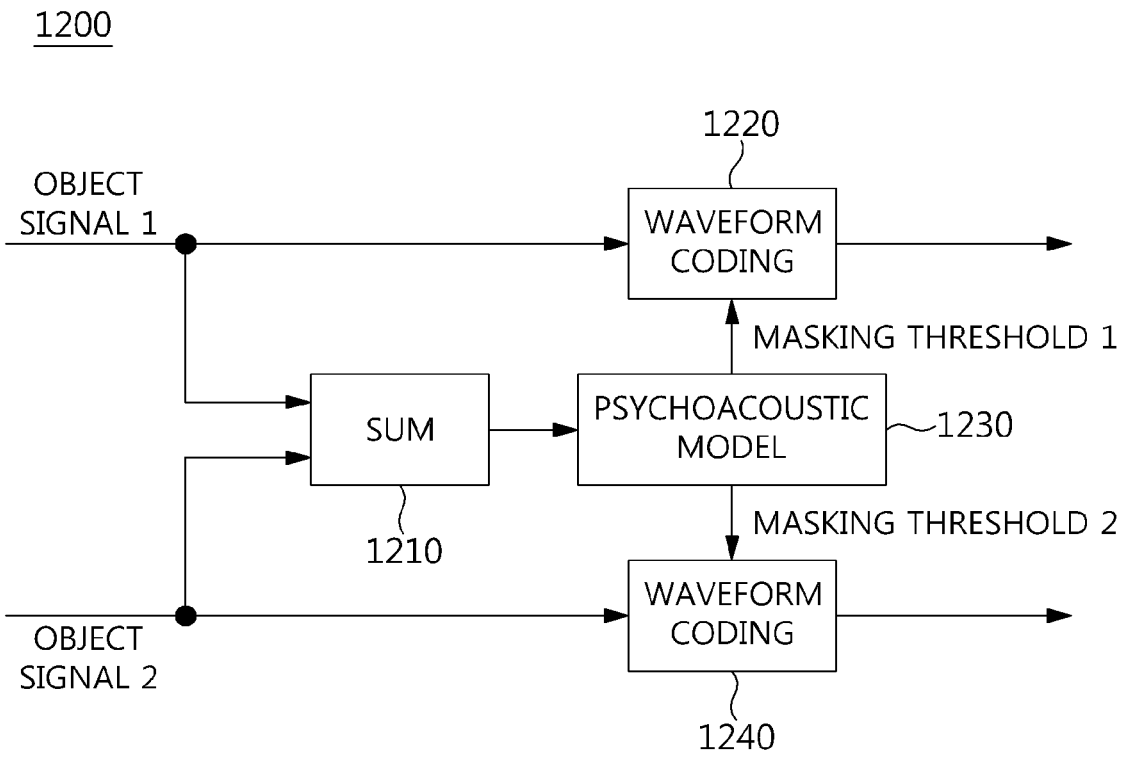
FIG. 12 is a diagram showing an embodiment of an encoder for calculating masking thresholds for a plurality of object signals according to the present invention.

FIG. 12 illustrates an embodiment of an encoder 1200 for calculating masking thresholds for a plurality of object signals according to the present invention so as to implement the configuration illustrated in FIG. 11. When two object signals are input, a SUM block 1210 for those signals generates a sum signal. A psychoacoustic model operation unit 1230 receives the sum signal as an input signal and individually calculates masking thresholds corresponding to the object 1 and the object 2. Here, although not shown in FIG. 12, signals for the object 1 and the object 2 may be additionally provided, as inputs of the psychoacoustic model operation unit 1230, in addition to the sum signal. Waveform coding 1220 for object signal 1 is performed using generated masking threshold 1, and then an encoded object signal 1 is output. Waveform coding 1240 for object signal 2 is performed using masking threshold 2, and then an encoded object signal 2 is output.

Another method of calculating masking thresholds according to the present invention is configured such that, when the locations of two objects are not completely identical to each other based on an auditory sense, masking levels may also be attenuated and reflected in consideration of a degree to which two objects are spaced apart from each other in a space instead of summing masking thresholds for two objects. That is, when a masking threshold for object 1 is M1(f) and a masking threshold for object 2 is M2(f), final joint masking thresholds M1'(f) and M2'(f) to be used to encode individual objects are generated to have the following relationship.

$$M1'(f)=M1(f)+A(f)M2(f)$$

$$M2'(f)=A(f)M1(f)+M2(f) \quad \text{[Equation 1]}$$

where A(f) is an attenuation factor generated using the spatial location and distance between two objects, the attributes of two objects, etc., and has a range of 0.0=<A(f)=<1.0.

The resolution of human orientation has the characteristics of decreasing in a direction from a front side to left and right sides, and of further decreasing in a direction to a rear side. Therefore, the absolute locations of the objects may act as other factors for determining A(f).

In another embodiment of the present invention, the threshold calculation method may be implemented using a method in which one of two objects uses its own masking threshold and only the other object fetches the masking threshold of the counterpart object. Such objects are called an independent object and a dependent object, respectively. Since an object that uses only its own masking threshold is encoded at high sound quality regardless of the counterpart object, there is the advantage of the sound quality being maintained even if rendering causing an object to be spatially separated from the corresponding object is performed. When the object 1 is an independent object and the object 2 is a dependent object, masking thresholds may be represented by the following equation:

$$M1'(f)=M1(f)$$

$$M2'(f)=A(f)M1(f)+M2(f) \quad \text{[Equation 2]}$$

Information about whether a given object is an independent object or a dependent object is preferably transferred to a decoder and a renderer as additional information about the corresponding object.

In a further embodiment of the present invention, when two objects are similar to each other to some degree in a space, it is possible to combine signals themselves into a single object signal and process the single object signal without summing only masking thresholds and generating joint masking thresholds.

In yet another embodiment of the present invention, when parametric coding, in particular, is performed, it is preferable to combine and process the two objects into a single object in consideration of a correlation between two signals and the spatial locations of the two signals.

(Transcoding Features)

In yet another embodiment of the present invention, in order to transcode a bitstream including coupled objects at a lower bit rate, it is preferable to represent the coupled objects by a single object when the number of objects must be reduced so as to reduce the size of data (that is, when a plurality of objects are downmixed and are represented by a single object).

Upon describing the above coding based on coupling between objects, a case where only two objects are coupled to each other has been exemplified for convenience of description, but coupling of two or more objects may be implemented in a similar manner.

(Requirement of Flexible Rendering)

Among technologies required for 3D audio, flexible rendering is one of important subjects to be solved so as to improve the quality of 3D audio up to a highest level. It is well known that the locations of 5.1 channel speakers are very irregular depending on the structure of a living room and the arrangement of pieces of furniture. Even if speakers are placed at such irregular locations, a sound scene intended by a content creator must be able to be provided. For this, rendering technology for correcting differences relative to locations based on standards is required together with the cognition of speaker environments in reproduction environments differing for respective users. That is, the function of a codec is not merely the decoding of transmitted bitstreams, and a series of technologies for a procedure for optimizing and transforming the decoded bitstreams in conformity with the user's reproduction environment are required.

Figure 13:
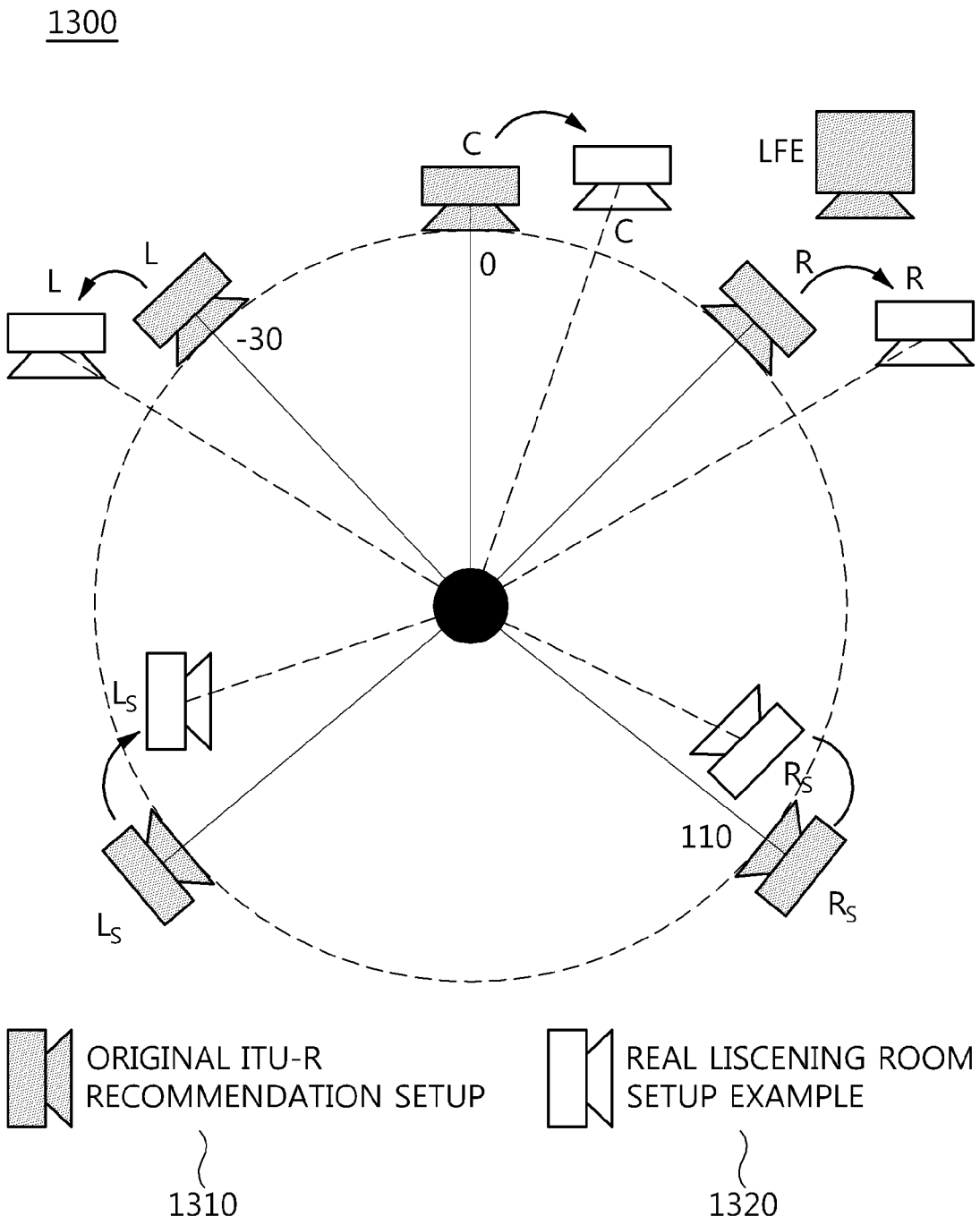
FIG. 13 is a diagram showing arrangement depending on ITU-R recommendations and arrangement at random locations for 5.1 channel setup.

FIG. 13 illustrates speakers 1310 (indicated in gray color) arranged according to ITU-R recommendations and speakers 1320 (indicated in white color) arranged at random locations for 5.1 channel setup. A problem may arise in that, in the environment of an actual living room, the azimuth angles and distances of speakers are changed unlike ITU-R recommendations (although not shown in the drawing, the heights of the speakers may also differ). When original channel signals are reproduced without change at the changed locations of speakers in this way, it is difficult to provide an ideal 3D sound scene.

(Flexible Rendering)

When amplitude panning for determining the orientation information of sound sources between two speakers based on the magnitudes of signals, or Vector-Based Amplitude Panning (VBAP) widely used to determine the orientation of sound sources using three speakers in a 3D space is used, it can be seen that flexible rendering may be relatively conveniently implemented for object signals transmitted for respective objects. This is one of the advantages of transmitting object signals instead of channel signals.

(Object Decoding and Rendering Structure)

Figure 14:
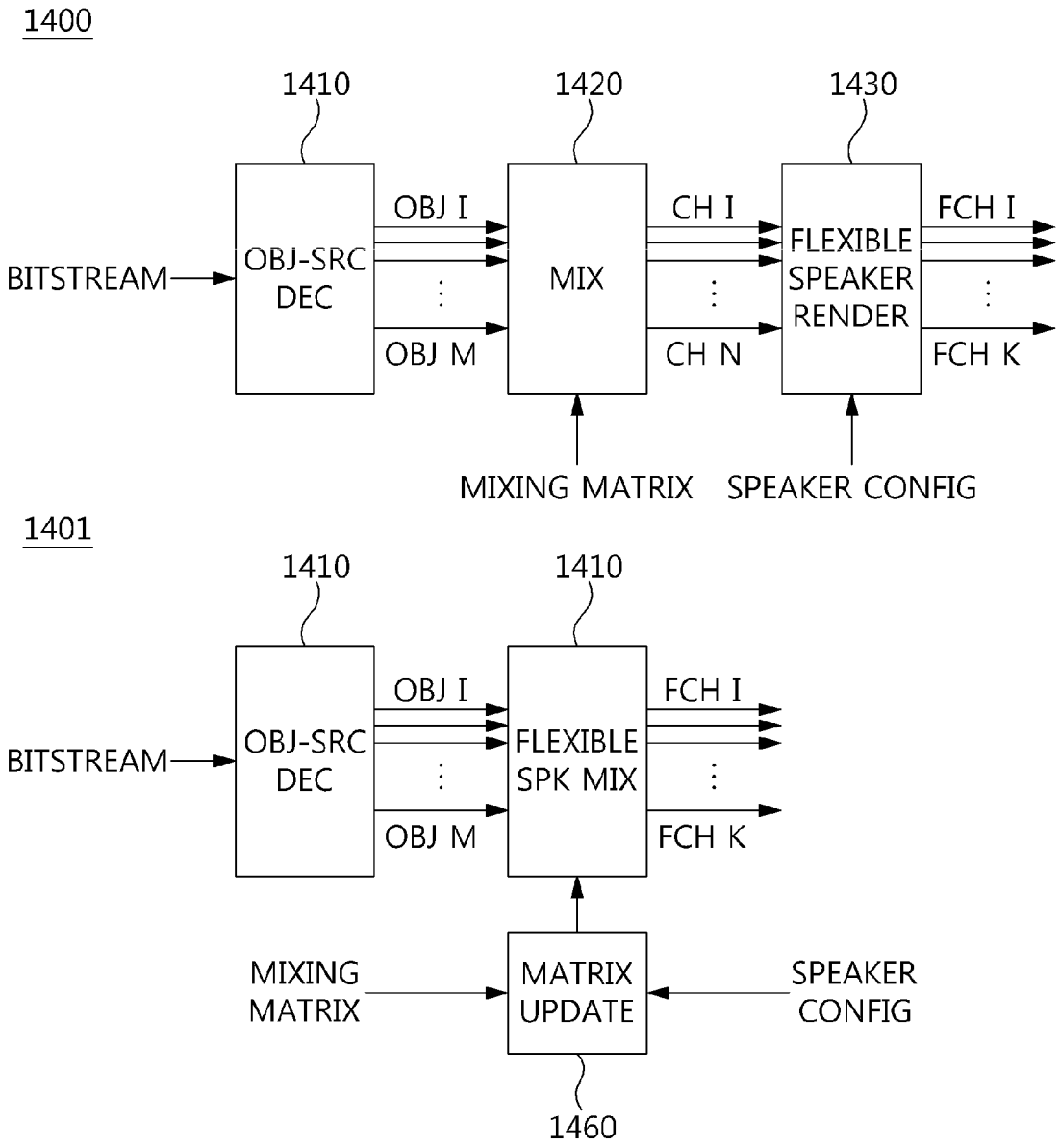
FIG. 14 is a diagram showing an embodiment of a structure in which a decoder for an object bitstream and a flexible rendering system using the decoder are connected to each other according to the present invention.

FIG. 14 illustrates structures 1400 and 1401 of two embodiments in which a decoder for an object bitstream and a flexible rendering system using the decoder are connected according to the present invention. As described above, such a structure is advantageous in that objects may be easily located as sound sources in conformity with a desired sound scene. Here, a mix unit 1420 receives location information represented by a mixing matrix and first changes the location information to channel signals. That is, the location information for the sound scene is represented by relative information from speakers corresponding to output channels. In this case, when the number of actual speakers and the locations of the speakers are not a designated number and are not designated locations, respectively, a procedure for re-rendering the channel signals using given location information Speaker Config is required. As will be described later, re-rendering of channel signals into other types of channel signals is more difficult to implement than direct rendering of objects to final channels.

Figure 15:
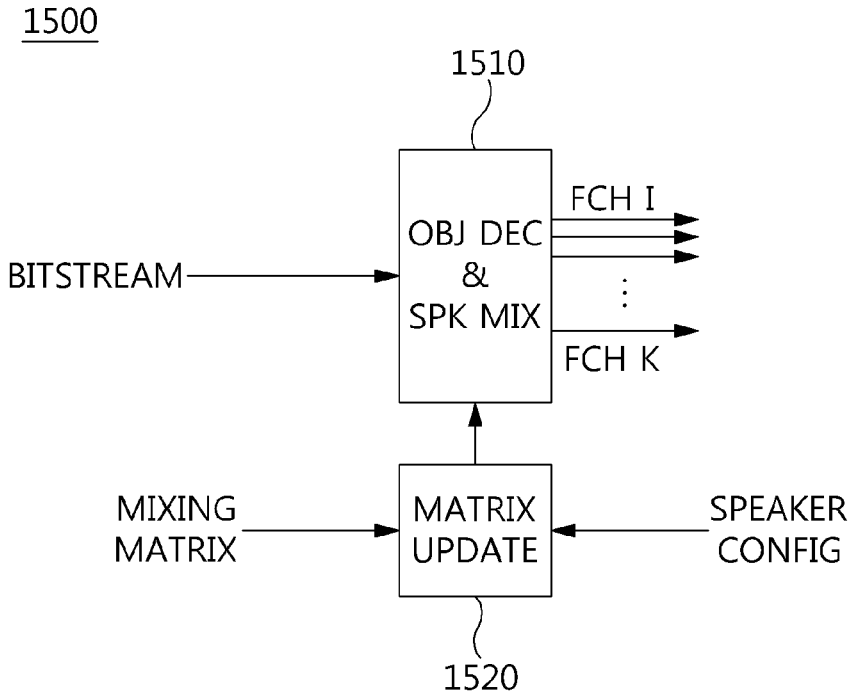
FIG. 15 is a diagram showing another embodiment of a structure in which decoding for an object bitstream and rendering are implemented according to the present invention.

FIG. 15 illustrates the structure 1500 of another embodiment in which decoding and rendering of an object bitstream are implemented according to the present invention. Compared to the case of FIG. 14, flexible rendering 1510 suitable for a final speaker environment, together with decoding, is directly implemented from the bitstream. That is, instead of two stages including mixing performed in regular channels based on a mixing matrix and rendering to flexible speakers from regular channels generated in this way, a single rendering matrix or a rendering parameter is generated using a mixing matrix and speaker location information 1520, and object signals are immediately rendered to target speakers using the rendering matrix or the rendering parameter.

(Flexible Rendering Combined with Channel)

Meanwhile, when channel signals are transmitted as input, and the locations of speakers corresponding to the channels are changed to random locations, it is difficult to apply a method such as a panning technique to object signals, and a separate channel mapping process is required. A bigger problem is that, since a procedure required for rendering and a solution method are different from each other between object signals and channel signals in this way, distortion may be easily caused due to spatial mismatch when object signals and channel signals are simultaneously transmitted and a sound scene in which two types of signals are mixed is desired to be created. To solve this problem, another embodiment according to the present invention is configured to primarily perform mixing on channel signals and secondarily perform flexible rendering on the channel signals without separately performing flexible rendering on the objects. Rendering or the like using Head Related Transfer Functions (HRTF) is preferably implemented in the similar manner.

(Downmixing in Decoding Stage: Parameter Transmission or Automatic Generation)

When multichannel content is reproduced through fewer output channels than the number of channels of the multichannel content in downmix rendering, it is general that such reproduction has been implemented to date using an M-N downmix matrix (where M is the number of input channels and N is the number of output channels). That is, when 5.1 channel content is reproduced in a stereo manner, reproduction is implemented in such a way as to perform downmixing using a given formula. However, such a downmixing method has a problem with a computational load in that, although the play speaker environment of a user is only 5.1 channel environment, all bitstreams corresponding to transmitted 22.2 channels must be decoded. Even for the generation of stereo signals to be played on a portable device, if all of 22.2 channel signals must be decoded, the burden of computation is very high, and a large amount of memory is wasted (for the storage of decoded signals for 22.2 channels).

(Transcoding as Alternative to Downmixing)

As an alternative thereto, a method of converting significant 22.2 channel original bitstreams into a number of bitstreams suitable for a target device or a target play space via effective transcoding may be considered. For example, for 22.2 channel content stored in a cloud server, a scenario for receiving reproduction environment information from a client terminal, converting the content in conformity with the reproduction environment information, and transmitting the converted information may be implemented.

(Decoding Sequence or Downmixing Sequence; Sequence Control Unit)

Figure 16:
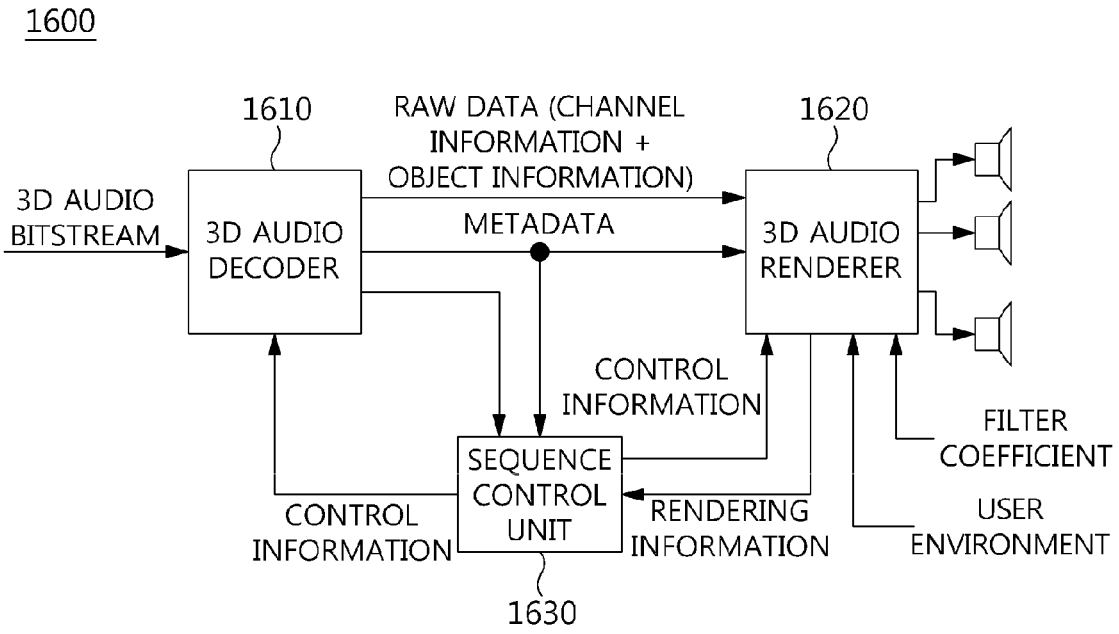
FIG. 16 is a diagram showing a structure for determining a transmission schedule and transmitting objects between a decoder and a renderer.

Meanwhile, in the case of a scenario in which a decoder and a renderer are separated, there may occur a case where 50 object signals, together with 22.2 channel audio signals, must be decoded and transferred to the renderer. In this case, the transmitted audio signals are signals which have been decoded and which have a high data rate, and thus a problem arises in that a very wide bandwidth between the decoder and the renderer is required. Therefore, it is not preferable to simultaneously transmit a large amount of data at once, and it is preferable to make an effective transmission plan. Further, the decoder preferably determines a decoding sequence according to the plan, and transmits the data. FIG. 16 is a block diagram showing a structure 1600 for determining a transmission plan between the decoder and the renderer and performing transmission in this way.

A sequence control unit 1630 acquires additional information via decoding of bitstreams, receives metadata, and also receives reproduction environment information, rendering information, etc. from a renderer 1620. Next, the sequence control unit 1630 determines control information such as a decoding sequence, a transmission sequence in which decoded signals are to be transmitted to the renderer 1620, and a transmission unit, using the received information, and returns the determined control information to a decoder 1610 and the renderer 1620. For example, when the renderer 1620 commands that a specific object should be completely deleted, the specific object does not need to be transmitted to the renderer 1620 and to be decoded. Alternatively, as another embodiment, when specific objects are intended to be rendered only to a specific channel, a transmission band may be reduced if the corresponding objects have been downmixed in advance into the specific channel and transmitted, instead of separately transmitting the corresponding objects. As a further embodiment, when a sound scene is spatially grouped, and signals required for rendering are transmitted together for each group, the number of signals to be unnecessarily waited for in the internal buffer of the renderer may be minimized. Meanwhile, the size of data that can be accepted at one time may differ depending on the renderer 1620. Such information may be reported to the sequence control unit 1630, so that the decoder 1610 may determine decoding timing and traffic in conformity with the reported information.

Meanwhile, the control of decoding by the sequence control unit 1630 may be transferred to an encoding stage, so that even an encoding procedure may be controlled. That is, it is possible for the encoder to exclude unnecessary signals from encoding, or determine the grouping of objects or channels.

(Audio Superhighway)

Meanwhile, in bitstreams, an object corresponding to bidirectional communication audio may be included. Bidirectional communication is very sensitive to a time delay, unlike other types of content. Therefore, when object signals or channel signals corresponding to bidirectional communication are received, they must be primarily transmitted to the renderer. The object or channel signals corresponding to bidirectional communication may be represented by a separate flag or the like. Such a primary transmission object has presentation time characteristics independent of other object/channel signals in the same frame, unlike other types of objects/channels.

(AV Matching and Phantom Center)

One of new problems, appearing when a UHDTV, that is, an ultra-high definition TV, is considered, is a situation commonly called a 'near field.' This means that, considering a viewing distance of a typical user environment (living room), a distance from a play speaker to a listener becomes shorter than a distance between respective speakers, and thus the respective speakers act as point sound sources, and that in a situation in which a center speaker is not present due to a wide and large screen, high-quality 3D audio service may be provided only when the spatial resolution of sound objects synchronized with a video is very high.

In a conventional viewing angle of about 30°, stereo speakers arranged on left and right sides are not in a near field situation, and a sound scene suitable for the movement of objects on a screen (for example, a vehicle moving from left to right) may be sufficiently provided. However, in a UHDTV environment in which a viewing angle reaches 100°, additional vertical resolution for configuring the upper and lower portion of the screen, as well as left and right horizontal resolution, is required. For example, when two characters appear on the screen, an existing HDTV does not cause a large problem in the sense of reality even if the sounds of the two characters are heard as if they were spoken at the center of the screen. However, in the size of UHDTV, mismatch between the screen and sounds corresponding thereto may be recognized as a new type of distortion.

As one of solutions to this, the form of a 22.2 channel speaker configuration may be exemplified. FIG. 2 illustrates an example of the arrangement of 22.2 channels. According to FIG. 2, a total of 11 speakers are arranged in a front position, so that the horizontal and vertical spatial resolutions of the front position are greatly improved. 5 speakers are arranged on a middle layer on which 3 speakers were placed in the past. Further, 3 speakers are added to each of a top layer and a bottom layer, so that the pitch of sounds may be sufficiently handled. When such arrangement is used, spatial resolution of the front position is increased compared to a conventional scheme, and thus matching with video signals may be profitable that much. However, current TVs using display devices such as a Liquid Crystal Display (LCD) and an Organic Light-Emitting Diode (OLED) are problematic in that locations where speakers must be placed are occupied by the display. That is, a problem arises in that, unless a display itself provides sounds or has device features of penetrating sounds, sound matching each object location in the screen must be provided using speakers located outside of a display area. In FIG. 2, at least speakers corresponding to Front Left center (FLc), Front Center (FC), and Front Right center (FRc) are arranged at locations overlapping the display.

Figure 17:
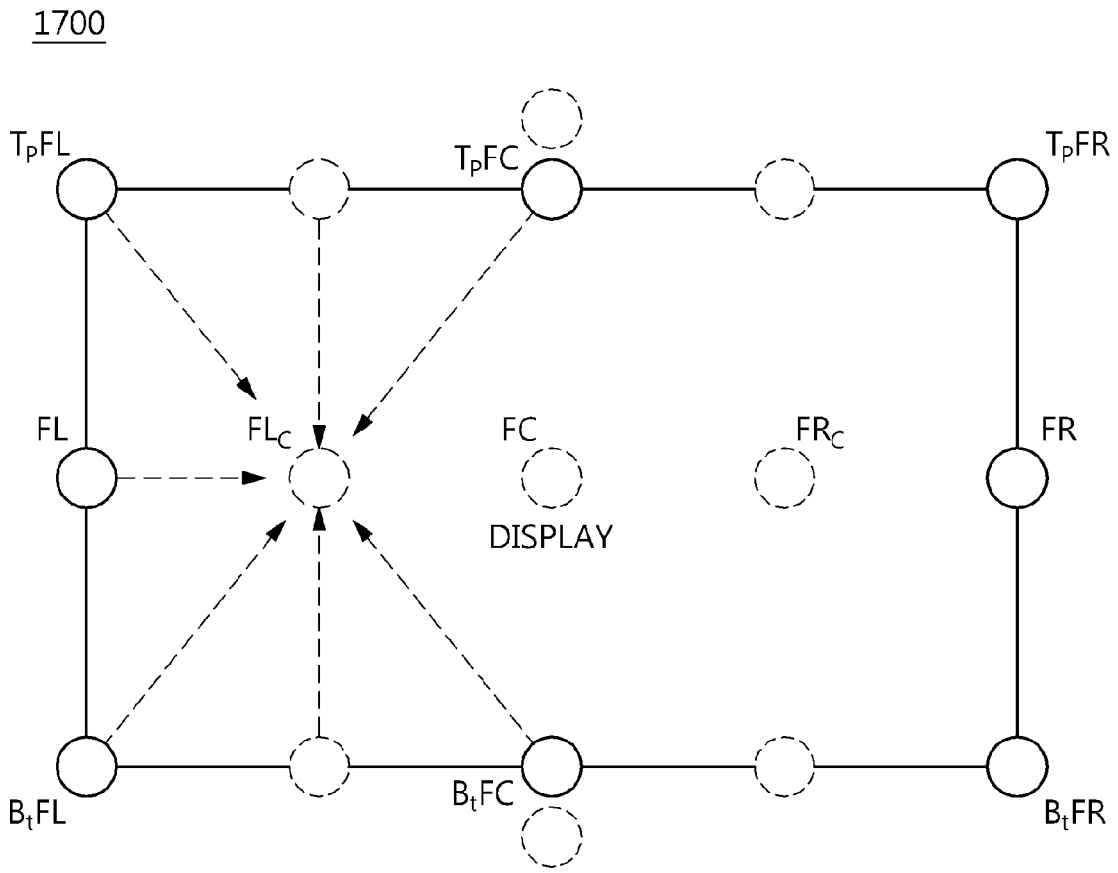
FIG. 17 is a conceptual diagram showing a concept in which sounds from speakers removed due to a display, among speakers arranged in a front position in a 22.2 channel system, are reproduced using neighboring channels thereof.

FIG. 17 is a conceptual diagram showing a concept in which sounds from speakers removed due to a display, among speakers arranged in a front position in a 22.2 channel system, are reproduced using neighboring channels thereof. In order to cope with the absence of FLc, FC, and FRc, a case may also be considered where additional speakers, such as circles indicated by dotted lines, may be arranged around the top and bottom portions of the display. Referring to FIG. 17, the number of neighboring channels that may be used to generate FLc may be 7. By using such 7 speakers, sounds corresponding to the locations of absent speakers may be reproduced based on the principle of creation of virtual sources.

For methods for generating virtual sources using neighboring speakers, technology or properties such as Vector Based Amplitude Panning (VBAP) or precedence effect (HAAS effect) may be used. Alternatively, depending on the frequency band, different panning techniques may be applied. Furthermore, the change of an azimuth angle and the adjustment of height using Head Related Transfer Functions (HRTF) may be taken into consideration. For example, when a speaker corresponding to a front center (FC) is replaced with a speaker corresponding to Bottom Front center (BtFC), such a virtual source generation method may be implemented using a method of adding an FC channel signal to BtFC may be implemented using the HRTF having rising properties. A property that can be detected by observing HRTF is that the location of a specific null in a high frequency band (differing for each person) must be controlled to adjust the pitch of sounds. However, in order to generalize and implement null locations differing for respective persons, pitch may be adjusted using a method of widening or narrowing a high frequency band. If such a method is used, a disadvantage of causing signal distortion due to the influence of a filter occurs instead.

Figure 18:
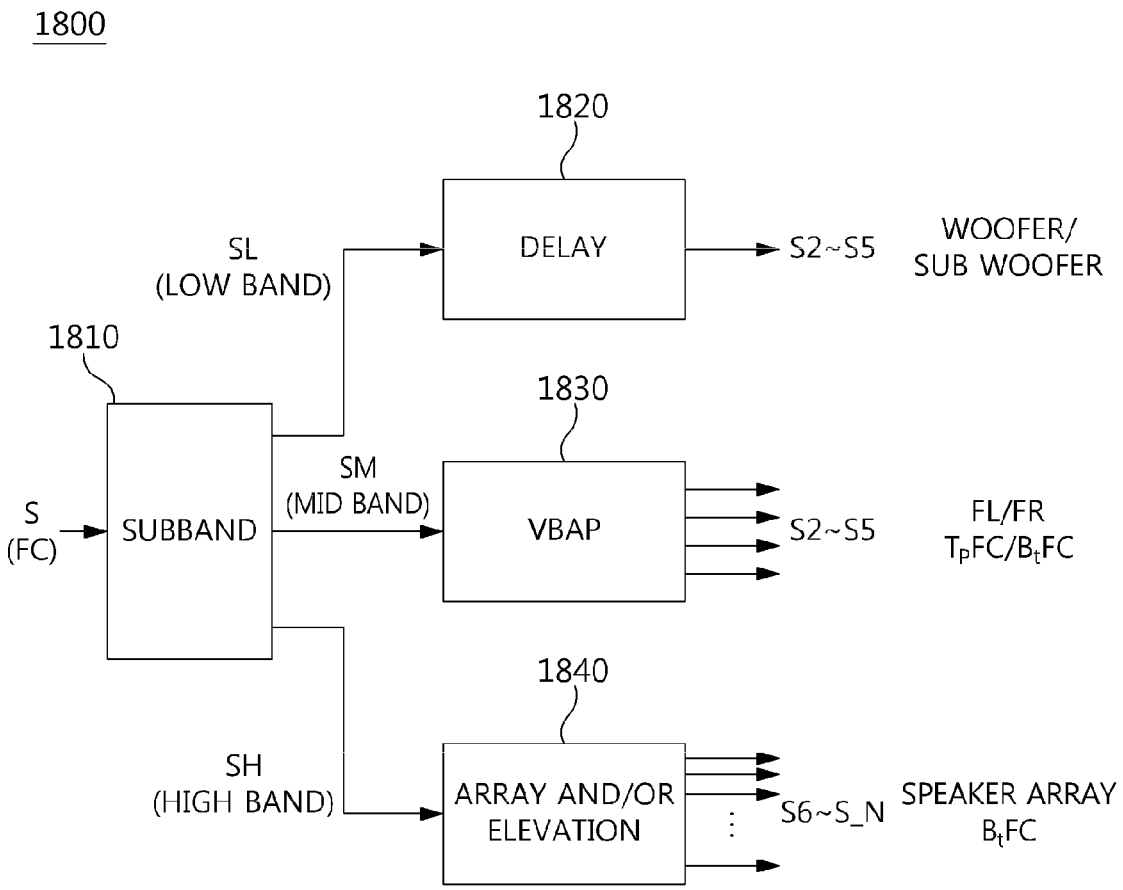
FIG. 18 is a diagram showing an embodiment of a processing method for arranging sound sources at the locations of absent speakers according to the present invention.

A processing method for arranging sound sources at the locations of absent (phantom) speakers according to the present invention is illustrated in FIG. 18. Referring to FIG. 18, channel signals corresponding to the locations of phantom speakers are used as input signals, and the input signals pass through a sub-band filter unit 1810 for dividing the signals into three bands. Such a method may also be implemented using a method having no speaker array. In this case, the method may be implemented in such a way as to divide the signals into two bands instead of three bands, or divide the signals into three bands and process two upper bands in different manners. A first band (SL, S1) is a low frequency band, which is relatively insensitive to location, but is preferably reproduced using a large speaker, and thus it can be reproduced via a woofer or subwoofer speaker. In this case, to use precedence effect, a first band signal may be delayed by a time delay filter unit 1820. Here, a time delay is intended to provide an additional time delay so as to reproduce the corresponding signal later than other band signals, that is, provide precedence effect, without intending to compensate for the time delay of the filter occurring during a processing procedure in other bands.

A second band (SM, S2~S5) is a signal to be used to be reproduced through speakers around phantom speakers (TV display bezel and speakers arranged around the display), and is divided into at least two speakers and reproduced. Coefficients required to apply a panning algorithm 1830 such as VBAP are generated and applied. Therefore, only when the number and locations of speakers through which the output of the second band is to be reproduced (relative to phantom speakers) are to be precisely provided, panning effect based on such information may be improved. In this case, in order to apply a filter considering HRTF or provide time panning effect in addition to VBAP panning, different phase filters or time delay filters may also be applied. Another advantage that can be obtained when bands are divided and HRTF is applied in this way is that the range of signal distortion occurring due to HRTF may be limited to be within a processing band.

A third band (SH, S6~S_N) is intended to generate signals to be reproduced using a speaker array when there is the speaker array, and a speaker array control unit 1840 may apply array signal processing technology for virtualizing sound sources through at least three speakers. Alternatively, coefficients generated via Wave Field Synthesis (WFS) may be applied. In this case, the third band and the second band may be actually identical to each other.

Figure 19:
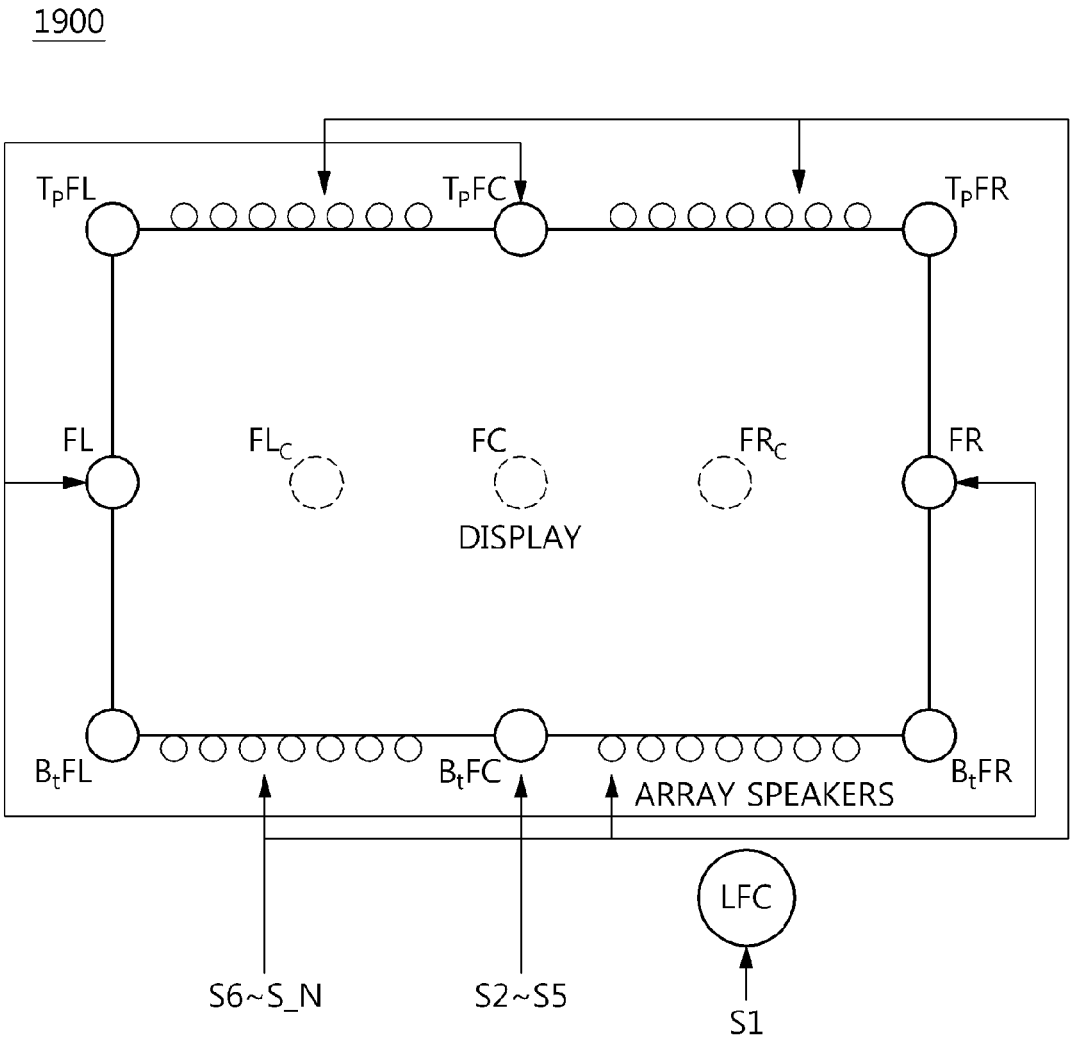
FIG. 19 is a diagram showing an embodiment of mapping of signals generated in respective bands to speakers arranged around a TV.

FIG. 19 illustrates an embodiment in which signals generated in respective bands are mapped to speakers arranged around a TV. Referring to FIG. 19, the number and locations of speakers corresponding to the second band (S2~S5) and the third band (S6~S_N) must be placed at relatively precisely defined locations. The location information is preferably provided to the processing system of FIG. 18.

Figure 20:
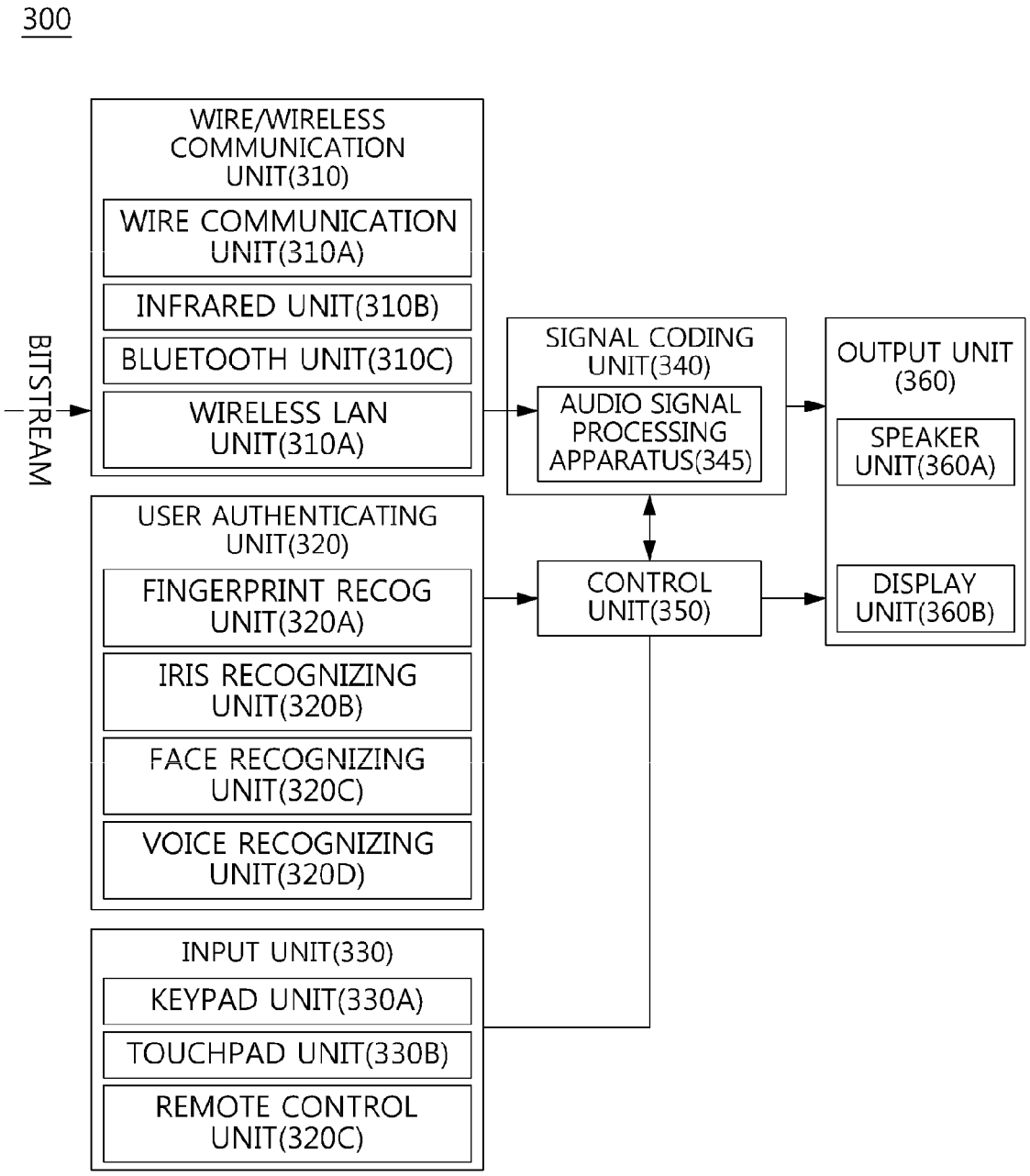
FIG. 20 is a diagram showing a relationship between products in which an audio signal processing device according to an embodiment of the present invention is implemented.

FIG. 20 is a diagram showing a relationship between products in which the audio signal processing device is implemented according to an embodiment of the present invention. Referring to FIG. 20, a wired/wireless communication unit 310 receives bitstreams in a wired/wireless communication manner. More specifically, the wired/wireless communication unit 310 may include one or more of a wired communication unit 310A, an infrared unit 310B, a Bluetooth unit 310C, and a wireless Local Area Network (LAN) communication unit 310D.

A user authentication unit 320 receives user information and authenticates a user, and may include one or more of a fingerprint recognizing unit 320A, an iris recognizing unit 320B, a face recognizing unit 320C, and a voice recognizing unit 320D, which respectively receive fingerprint information, iris information, face contour information, and voice information, convert the information into user information, and determine whether the user information matches previously registered user data, thus performing user authentication.

An input unit 330 is an input device for allowing the user to input various types of commands, and may include, but is not limited to, one or more of a keypad unit 330A, a touch pad unit 330B, and a remote control unit 330C.

A signal coding unit 340 performs encoding or decoding on audio signals and/or video signals received through the wired/wireless communication unit 310, and outputs audio signals in a time domain. The signal coding unit 340 may include an audio signal processing device 345. In this case, the audio signal processing device 345 corresponds to the above-described embodiments (the decoder 600 according to an embodiment and the encoder/decoder 1400 according to another embodiment), and such an audio signal processing device 345 and the signal coding unit 340 including the device may be implemented using one or more processors.

A control unit 350 receives input signals from input devices and controls all processes of the signal coding unit 340 and an output unit 360. The output unit 360 is a component for outputting the output signals generated by the signal coding unit 340, and may include a speaker unit 360A and a display unit 360B. When the output signals are audio signals, they are output through the speaker unit, whereas when the output signals are video signals, they are output via the display unit.

The audio signal processing method according to the present invention may be produced in a program to be executed on a computer and stored in a computer-readable storage medium. Multimedia data having a data structure according to the present invention may also be stored in a computer-readable storage medium. The computer-readable recording medium includes all types of storage devices readable by a computer system. Examples of a computer-readable storage medium include Read Only Memory (ROM), Random Access Memory (RAM), Compact Disc ROM (CD-ROM), magnetic tape, a floppy disc, an optical data storage device, etc., and may include the implementation of the form of a carrier wave (for example, via transmission over the Internet). Further, the bitstreams generated by the encoding method may be stored in the computer-readable medium or may be transmitted over a wired/wireless communication network.

As described above, although the present invention has been described with reference to limited embodiments and drawings, it is apparent that the present invention is not limited to such embodiments and drawings, and the present invention may be changed and modified in various manners by those skilled in the art to which the present invention pertains without departing from the technical spirit of the present invention and equivalents of the accompanying claims.

MODE FOR INVENTION

As described above, related contents in the best mode for practicing the present invention have been described.

INDUSTRIAL APPLICABILITY

The present invention may be applied to procedures for encoding and decoding audio signals or for performing various types of processing on audio signals.

The invention claimed is:

1. An audio signal processing method, comprising:

receiving a first signal for a first object audio signal group comprising a plurality of object audio signals and a second signal for a second object audio signal group comprising a plurality of object audio signals;

receiving first metadata for the first object audio signal group and second metadata for the second object audio signal group;

generating object audio signals belonging to the first object audio signal group using the first signal and the first metadata; and generating audio object signals belonging to the second object audio signal group using the second signal and the second metadata, wherein each of the first and second metadata comprises location information of each object corresponding to each object audio signal belonging to each of the first and second object audio signal groups, and wherein when the object is a dynamic object a location of which is time-varying, the location information of the object represents a location value relative to a previous location value of the object.

2. The audio signal processing method of claim 1, further comprising generating output audio signals using at least one of the object audio signals belonging to the first object audio signal group and at least one of the object audio signals belonging to the second object audio signal group.

3. The audio signal processing method of claim 1, wherein the first metadata and the second metadata are received from a single bitstream.

4. The audio signal processing method of claim 1, wherein downmix gain information for at least one of the object audio signals belonging to the first object audio signal group is obtained from the first metadata, and the at least one object audio signal is generated using the downmix gain information.

5. The audio signal processing method of claim 1, further comprising receiving global gain information, wherein the global gain information is a gain value applied both to the first object audio signal group and to the second audio object signal group.

6. The audio signal processing method of claim 1, wherein at least one of the object audio signals belonging to the first object audio signal group and at least one of the object audio signals belonging to the second object audio signal group are reproduced in an identical time slot.

7. The audio signal processing method of claim 1, wherein the first or second metadata further comprises information indicating that the location information of the object represents a location value relative to a previous location value of the object.

* * * * *